US006435661B1

(12) United States Patent
Inoue et al.

(10) Patent No.: US 6,435,661 B1
(45) Date of Patent: Aug. 20, 2002

(54) LIQUID DISCHARGE HEAD, LIQUID DISCHARGE METHOD AND LIQUID DISCHARGE APPARATUS

(75) Inventors: Ryoji Inoue, Kawasaki; Hiroshi Sugitani, Machida; Masanori Takenouchi, Yokohama; Masami Ikeda; Masahiko Kubota, both of Tokyo; Kiyomitsu Kudo, Kawasaki; Takashi Saito, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/650,996

(22) Filed: Aug. 31, 2000

(30) Foreign Application Priority Data

Sep. 3, 1999 (JP) ..... 11-250937

(51) Int. Cl.[7] ..... B41J 2/14; B41J 2/05
(52) U.S. Cl. ..... 347/48; 347/65
(58) Field of Search ..... 347/48, 63–67, 347/62

(56) References Cited

U.S. PATENT DOCUMENTS

| | | | | |
|---|---|---|---|---|
| 4,723,129 A | | 2/1988 | Endo et al. | 347/56 |
| 5,278,585 A | | 1/1994 | Karz et al. | 347/65 |
| 5,754,201 A | * | 5/1998 | Ishinaga et al. | 347/62 |
| 5,821,962 A | * | 10/1998 | Kudo et al. | 347/65 |
| 6,095,640 A | | 8/2000 | Ishinaga et al. | 347/65 |
| 6,164,763 A | | 12/2000 | Sugama et al. | 347/63 |
| 6,196,667 B1 | | 3/2001 | Hiroki et al. | 347/65 |
| 6,217,157 B1 | | 4/2001 | Yoshihira et al. | 347/65 |

FOREIGN PATENT DOCUMENTS

EP 737581 A2 * 10/1996 ..... B41J/2/05

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

There is disclosed a liquid discharge head comprises a discharge port for discharging a liquid, a liquid flow path with one end constantly communicating with the discharge port and with a bubble generating area for generating a bubble in the liquid, a liquid supply port disposed in the liquid flow path and connected to a common liquid supply chamber for storing the liquid to be supplied to the liquid flow path, a plurality of bubble generating means, disposed in the liquid flow path, for generating the bubble in the liquid, and a plate-like movable member disposed in the liquid flow path with the side of the discharge port supported as a free end at a gap of 10 $\mu$m or less with respect to the liquid supply port on the side of the liquid flow path, and provided with a projection area larger than an opening area of the liquid supply port. The discharge port is in a linear communication state with the bubble generating means, and by driving the bubble generating means for generating the bubble with a smallest volume among the plurality of bubble generating means, the movable member seals and substantially shuts off the liquid supply port, which can increase a discharge amount ratio of liquid droplets, equalize liquid droplet discharge speeds, and raise a refill frequency after discharge.

36 Claims, 23 Drawing Sheets

LIQUID DISCHARGE HEAD, LIQUID DISCHARGE METHOD AND LIQUID DISCHARGE APPARATUS

BACKGROUND OF THE INVENTION

1. Field of the Invention

The present invention relates to a liquid discharge head for applying a thermal energy to a liquid to generate a bubble and discharge the liquid, a liquid discharge method, and a liquid discharge apparatus.

Moreover, the present invention can be applied to apparatuses for performing recording on recording media such as paper, thread, fiber, cloth, leather, metal, plastic, glass, wood, ceramic, and the like, such as a printer, a copying machine, a facsimile machine provided with a communication system, and a word processor provided with a printer section, and further to an industrial recording apparatus combined with various processing apparatuses in a composite manner.

Additionally, "recording" in the present invention means not only that a character image, a diagram image or another meaningful image is given to the recording medium, but also that a pattern image or another meaningless image is given.

2. Related Background Art

In conventional recording apparatuses such as a printer, an ink jet recording method, a so-called bubble jet recording method is known which comprises applying heat or another energy to a liquid ink in a flow path to generate a bubble, discharging the ink from a discharge port by an action force based on a steep volume change with the bubble, and attaching the ink to a recording medium to form an image. In a recording apparatus using the bubble jet recording method, as disclosed in U.S. Pat. No. 4,723,129 or the like, the discharge port for discharging the ink, the flow path connected to the discharge port, and an electrothermal converting element as energy generating means, disposed in the flow path, for discharging the ink are usually arranged.

According to the recording method, a high quality level image can be recorded with a high speed and a low noise, and the discharge ports for discharging the ink can be arranged with a high density in a head to perform the recording method, which provides many advantages that a high-resolution recorded image and further a color image can easily be obtained with a small-sized apparatus. Therefore, in recent years the bubble jet recording method has been utilized in many office apparatuses such as a printer, a copying machine, and a facsimile machine, and further in industrial systems such as a textile printing machine.

Various demands have been raised with utilization of such bubble jet technique in products of various fields, and for example, there are proposed drive conditions for providing a liquid discharge method to perform a satisfactory ink discharge with a fast ink discharge speed based on a stable bubble generation in order to obtain a high quality image, or improvement of a flow path configuration to obtain a liquid discharge head fast in refill speed of a discharged liquid into a liquid flow path from a viewpoint of high-speed recording.

Furthermore, in order to simultaneously achieve highly detailing of a recorded image and increasing of a printing speed, there is proposed a constitution in which a plurality of electrothermal converting elements are arranged in one liquid flow path (nozzle) and liquid droplets different in size are discharged from the same nozzle.

The discharge amount, discharge speed, refill frequency and other liquid discharge properties of the liquid discharge head are generally determined by three elements: (1) flow resistance before a heater (on a downstream side with respect to a flow direction of the liquid in the liquid flow path); (2) flow resistance behind the heater (on an upstream side); and (3) ratio of the flow resistance before the heater to the flow resistance behind the heater. Therefore, for the liquid discharge head, by adjusting a liquid flow path structure, heater size, arrangement position, and the like, the aforementioned three elements are appropriately changed, and a desired discharge property is obtained in the constitution.

SUMMARY OF THE INVENTION

In a liquid discharge head in which a plurality of electrothermal converting elements are arranged in one nozzle, and liquid droplets different in size are discharged from the same nozzle (hereinafter referred to also as "discharge amount modulation head"), in order to realize highly detailing of a recorded image and accelerating of a printing speed, a discharge amount modulation ratio (volume ratio of a small liquid droplet to a large liquid droplet) needs to be increased.

When the discharge amount modulation ratio is increased, however, a discharge speed difference between the small and large liquid droplets increases and a deviation is generated in reaching (dot placement) position of the liquid droplet to a recording medium. Therefore, the small or large liquid droplet cannot be discharged within one scanning stroke, or it is necessary in some cases to change a discharge timing in accordance with a size of the liquid droplet to be discharged or to perform another high-grade image processing process. Moreover, when a size ratio of heaters disposed on one nozzle is increased, a nozzle length has to be increased, which deteriorates a refill frequency or exerts another large influence on a discharge property.

For the discharge amount modulation head, the discharge speeds of the respective liquid droplets are required to be substantially equal, while the discharge amount modulation head discharges different sizes of liquid droplets from the same nozzle, and it is difficult to optimize a nozzle structure for discharging the respective sizes of the liquid droplets. Moreover, since a plurality of heaters are arranged within one nozzle in the discharge amount modulation head, a heater size or a degree of freedom in arrangement position is limited in some cases.

As described above, in the discharge amount modulation head, much higher-grade condition is required concerning design than in a general liquid discharge head in which one heater is disposed in one nozzle. In a conventional art, in order to satisfy these conditions, a discharge efficiency is deteriorated and a head temperature easily rises, or it is necessary to increase dimensional precision or assembly precision of constituting components.

Therefore, an object of the present invention is to provide a liquid discharge head, liquid discharge method and liquid discharge apparatus in which a discharge amount ratio of liquid droplets can be increased, substantially equal discharge speeds of the respective liquid droplets can be provided, and a refill frequency after discharge can be raised.

To achieve the aforementioned objects, according to the present invention there is provided a liquid discharge head comprising: a discharge port for discharging a liquid; a liquid flow path whose one end portion constantly communicates with the discharge port and which comprises a plurality of bubble generating areas for generating a bubble in the liquid; a liquid supply port disposed in the liquid flow path and connected to a common liquid supply chamber for storing the liquid to be supplied to the liquid flow path; a plurality of bubble generating means, disposed in the liquid flow path, for generating the bubble in the liquid; and a plate-like movable member disposed in the liquid flow path with the side of the discharge port supported as a free end at a gap of 10 $\mu$m or less with respect to the liquid supply port on the side of the liquid flow path, and provided with a projection area larger than an opening area of the liquid supply port. The discharge port is in a linear communication state with the bubble generating means, and by driving the bubble generating means for generating the bubble with a smallest volume among the plurality of bubble generating means, the movable member seals and substantially shuts off the liquid supply port.

Moreover, according to the present invention there is provided a liquid discharge head comprising: a discharge port for discharging a liquid; a liquid flow path whose one end portion constantly communicates with the discharge port and which comprises a plurality of bubble generating areas for generating a bubble in the liquid; a liquid supply port disposed in the liquid flow path and connected to a common liquid supply chamber for storing the liquid to be supplied to the liquid flow path; a plurality of bubble generating means, disposed in the liquid flow path, for generating the bubble in the liquid; and a plate-like movable member disposed in the liquid flow path with the side of the discharge port supported as a free end at a gap of 10 pm or less with respect to the liquid supply port on the side of the liquid flow path, and provided with a projection area larger than an opening area of the liquid supply port. The discharge port is in a linear communication state with the bubble generating means, and by selecting one of the plurality of bubble generating means, during generation of the bubble, and even during driving of any bubble generating means, the movable member seals and substantially shuts off the liquid supply port.

According to the liquid discharge head of the present invention constituted as described above, a part of the liquid filling the liquid flow path is heated by a heat generating member (bubble generating means), the movable member closely abuts on the peripheral portion of the liquid supply port to close the liquid supply port substantially simultaneously with occurrence of film boiling, and the inside of the liquid flow path is substantially in the sealed state excluding the discharge port.

Therefore, a pressure wave is inhibited from being propagated to the side of the liquid supply port, no liquid moves to the back of the heat generating member during discharge of the liquid, and a flow resistance behind the heat generating member is supposedly substantially infinite. Furthermore, since the flow resistance behind the heat generating member (on an upstream side) is substantially infinite, the ratio of the flow resistance before the heat generating member to the flow resistance behind the heat generating member constantly becomes substantially zero even with the change of the flow resistance before the heat generating member (on a downstream side). Therefore, for the liquid discharge head of the present invention, the liquid discharge property is determined only by the "flow resistance before the heat generating member (on the downstream side)" among three elements which determine the liquid discharge property.

The liquid discharge speed is inversely proportional to the flow resistance before the heat generating member, and is proportional to a bubbling power determined by an effective discharge area of the heat generating member. Moreover, since the discharge amount of the liquid discharged from the discharge port is proportional to the effective discharge area of the heat generating member, in the liquid discharge head of the present invention, by setting the ratios of the flow resistance before the respective heat generating members disposed in the same liquid flow path (on the downstream side) to the discharge amount to be equal, the discharge speeds of respective liquid droplets discharged by heating the respective heat generating members become equal. Thereby, according to the present invention, even when the liquid droplet discharge amount ratio is increased, it is easy to equalize the discharge speeds of the respective liquid droplets.

Moreover, the plurality of bubble generating means disposed in the liquid flow path are preferably arranged in order in which a bubbling area gradually increases toward the upstream side from the downstream side of the liquid flow path.

Furthermore, there may also be a gap between a liquid flow path wall constituting the liquid flow path and the movable member.

Moreover, the liquid may be discharged by driving the plurality of bubble generating means. In this case, the liquid may be discharged by simultaneously driving the plurality of bubble generating means. Moreover, the liquid may be discharged by first driving the bubble generating means closest to a discharge port side among the plurality of bubble generating means. Furthermore, the liquid may be discharged by first driving the bubble generating means closest to a movable member side among the plurality of bubble generating means.

Moreover, according to the present invention, there is provided a liquid discharge method using a liquid discharge head comprising: a discharge port for discharging a liquid; a liquid flow path whose one end portion constantly communicates with the discharge port and which comprises a plurality of bubble generating areas for generating a bubble in the liquid; a liquid supply port disposed in the liquid flow path and connected to a common liquid supply chamber for storing the liquid to be supplied to the liquid flow path; a plurality of bubble generating means, disposed in the liquid flow path, for generating the bubble in the liquid with which the liquid flow path is filled; and a movable member disposed in the liquid flow path with the side of the discharge port supported/fixed as a free end at a slight gap between a liquid flow path wall constituting the liquid flow path and the liquid supply port with respect to the liquid flow path wall and the liquid discharge port on the side of the liquid flow path, and provided with a projection area larger than an opening area of the liquid supply port. By driving the bubble generating means for generating the bubble with a smallest volume among the plurality of bubble generating means to generate the bubble, from when a drive voltage is applied to the bubble generating means until a period of substantially isotropic growth of the entire bubble ends, the movable member seals and substantially shuts off the liquid supply port.

Moreover, according to the present invention, there is provided a liquid discharge method using a liquid discharge head comprising: a discharge port for discharging a liquid; a liquid flow path whose one end portion constantly communicates with the discharge port and which comprises a plurality of bubble generating areas for generating a bubble in the liquid; a liquid supply port disposed in the liquid flow path and connected to a common liquid supply chamber for storing the liquid to be supplied to the liquid flow path; a plurality of bubble generating means, disposed in the liquid flow path, for generating the bubble in the liquid with which the liquid flow path is filled; and a movable member disposed in the liquid flow path with the side of the discharge port supported/fixed as a free end at a slight gap between a liquid flow path wall constituting the liquid flow path and the liquid supply port with respect to the liquid flow path wall and the liquid discharge port on the side of the liquid flow path, and provided with a projection area larger than an opening area of the liquid supply port. In a case of generating the bubble by selecting one of the plurality of bubble generating means, from when a drive voltage is applied to the bubble generating means until a period of substantially isotropic growth of the entire bubble ends, the movable member seals and substantially shuts off the liquid supply port even during driving any bubble generating means.

Thereby, the liquid flows into the liquid flow path before a retreat amount of a meniscus formed in the discharge port is maximized, and a flow for rapidly drawing the meniscus into the liquid flow path is rapidly reduced, so that the meniscus retreat amount decreases, and the meniscus starts to return to a position before bubbling at a relatively low speed. As a result, after the discharge, a time when the meniscus returns to its initial state is very short. Specifically, since a time for completing refilling of a constant amount of ink to the liquid flow path is very short, during performing of a high-precision (constant amount) ink discharge, even a discharge frequency (drive frequency) can rapidly be enhanced.

Furthermore, a bubble growth volume change and a time from bubble generation until bubble vanishing may largely differ between the discharge port side and the liquid supply port side in the bubble generating area in the constitution.

Additionally, the bubble generating area may not be opened to atmosphere in the constitution.

According to the present invention, there is provided a liquid discharge apparatus comprising: the liquid discharge head of the present invention; and drive signal supply means for supplying a drive signal for discharging a liquid from the liquid discharge head. Moreover, according to the present invention there is provided a liquid discharge apparatus comprising: the liquid discharge head of the present invention; and recording medium conveying means for conveying a recording medium to receive a liquid discharged from the liquid discharge head.

Furthermore, recording may be performed by discharging an ink from the liquid discharge head and attaching the ink to the recording medium in the constitution.

Other effects of the present invention will be understood from description of respective embodiments.

Additionally, "upstream" and "downstream" for use in the description of the present invention are represented with respect to a flow direction of the liquid toward the discharge port from a liquid supply source via the bubble generating area (or the movable member), or with respect to a constitutional direction.

Moreover, "downstream side" regarding the bubble itself means the bubble generated on a downstream side of the flow direction or the constitutional direction with respect to a bubble center, or in an area on the downstream side from an area center of the heat generating member.

Furthermore, expression "the movable member seals and substantially shuts off the liquid supply port" in the present invention includes a case in which the movable member does not necessarily closely abut on the peripheral portion of the liquid supply port, and limitlessly approaches the liquid supply port.

DETAILED DESCRIPTION OF THE PREFERRED EMBODIMENTS

Embodiments of the present invention will next be described with reference to the drawings.

(First Embodiment)

Figure 1:
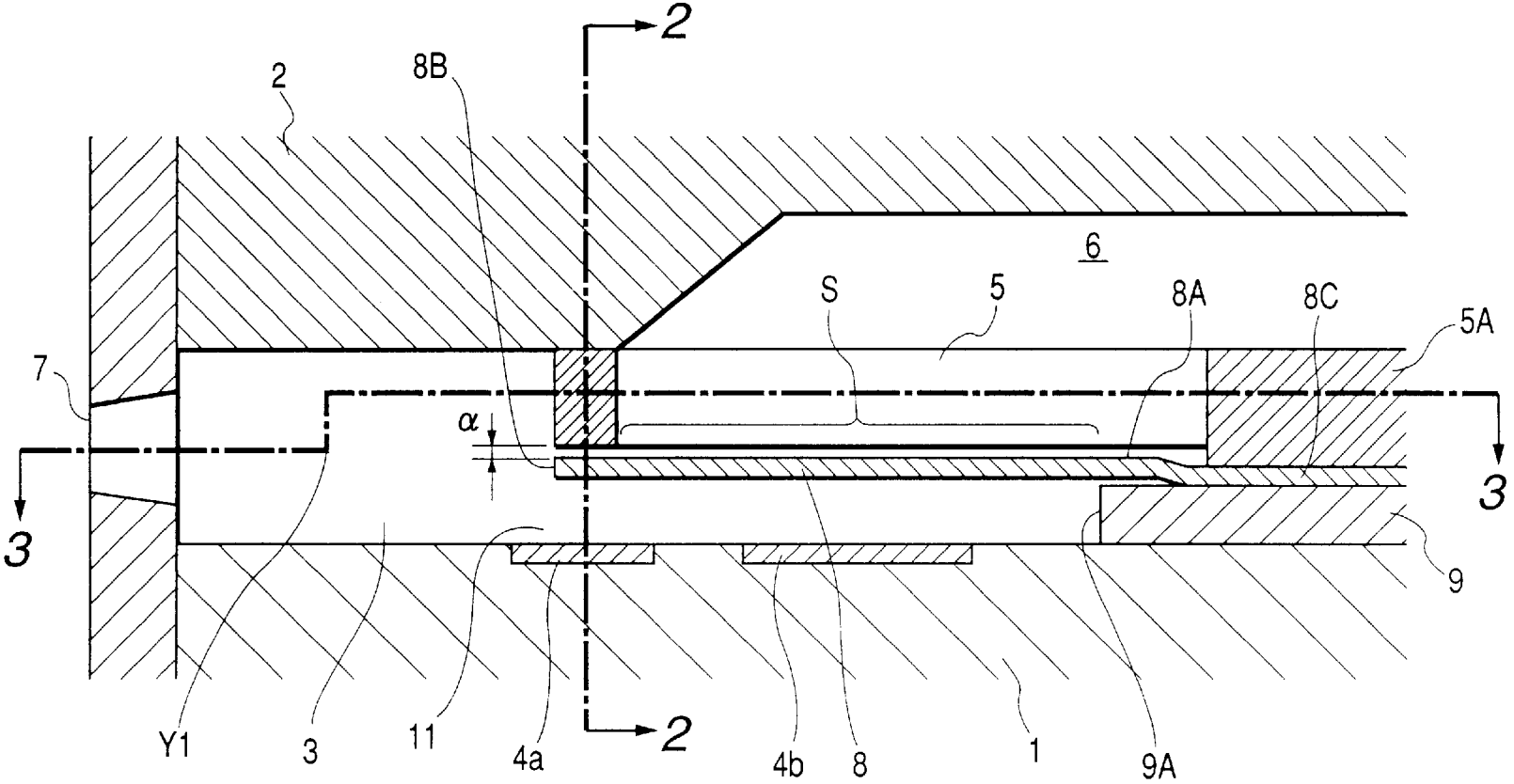
FIG. 1 is a sectional view along one liquid flow path direction of a liquid discharge head according to a first embodiment of the present invention.
Figure 2:
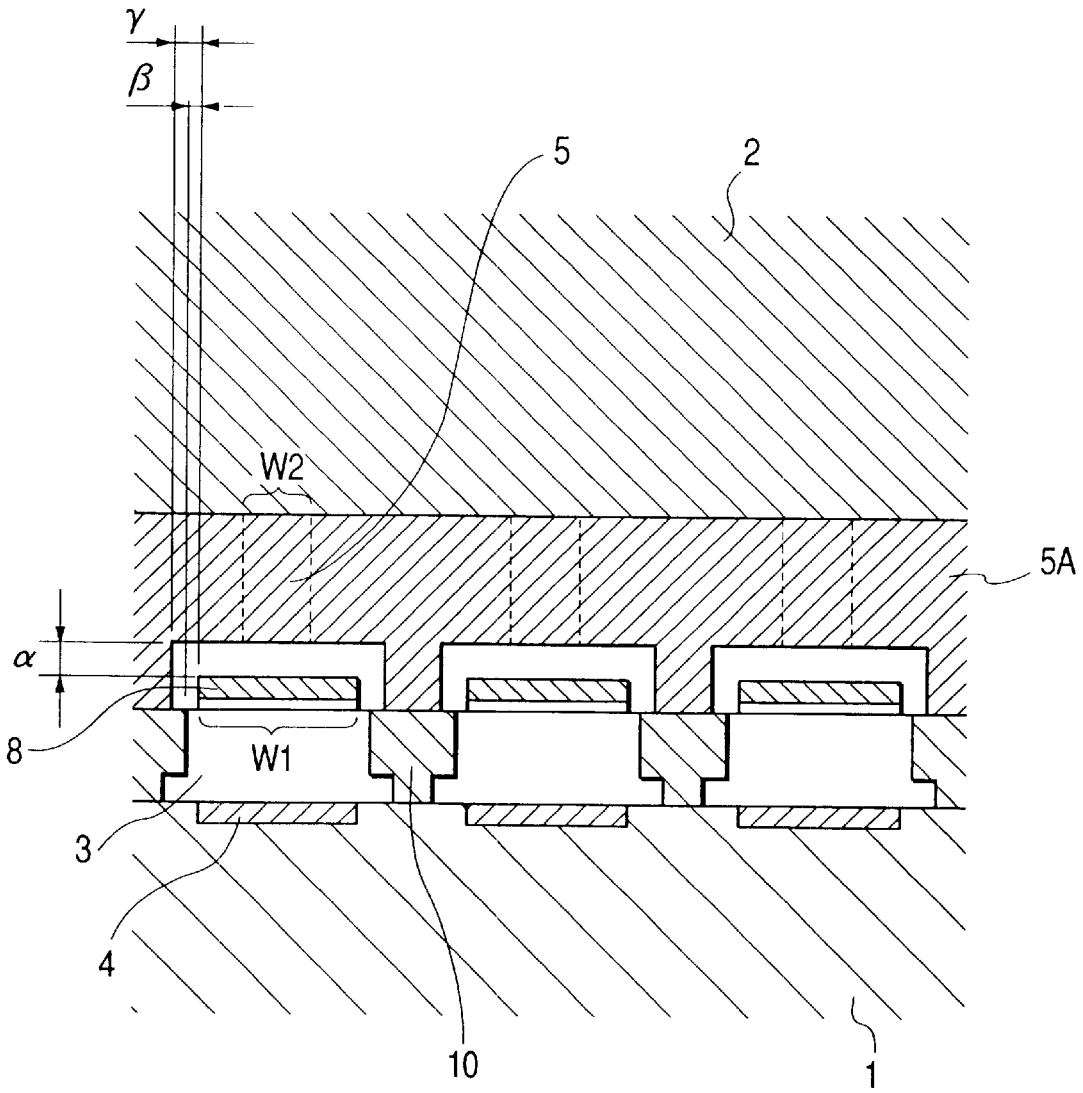
FIG. 2 is a sectional view along a 2—2 line of the liquid discharge head shown in FIG. 1.
Figure 3:
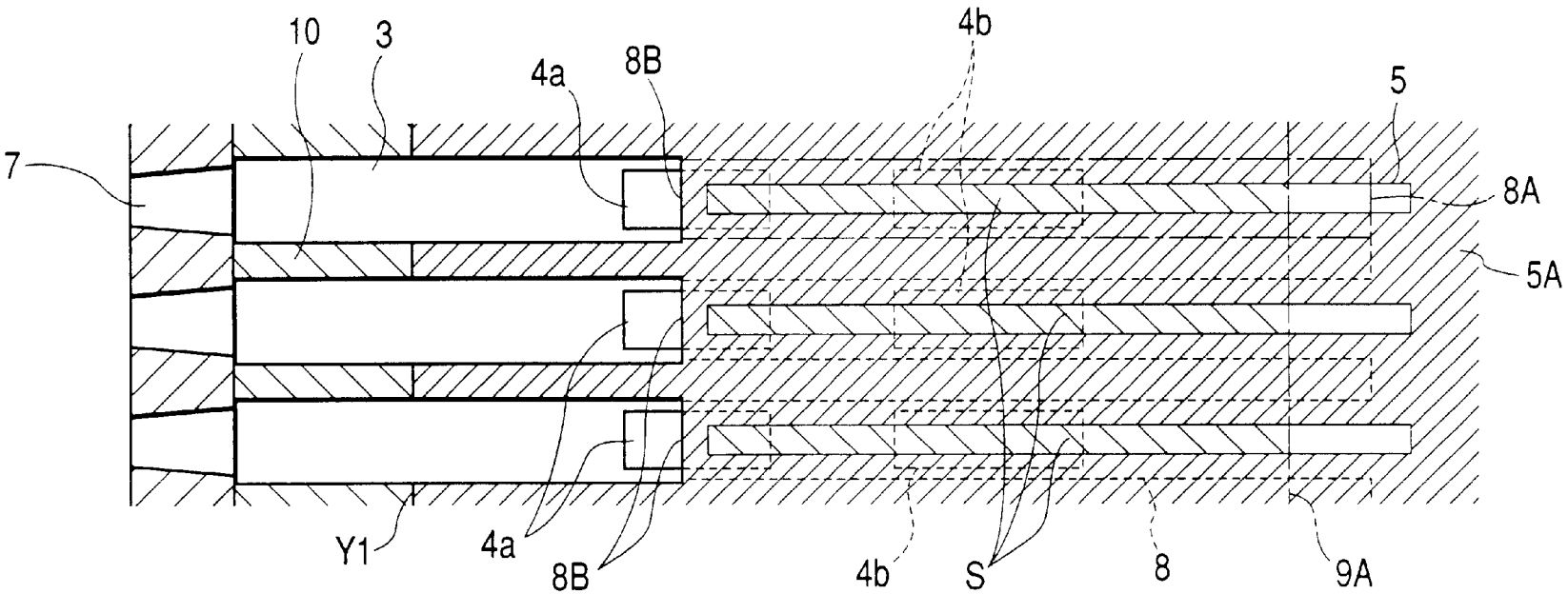
FIG. 3 is a sectional view along a 3—3 line of the liquid discharge head shown in FIG. 1.

FIG. 1 is a sectional view along one liquid flow path direction of a liquid discharge head according to a first embodiment of the present invention, FIG. 2 is a sectional view along a 2—2 line of the liquid discharge head shown in FIG. 1, and FIG. 3 is a sectional view along a 3—3 line, shifted to the side of a top plate 2 at a point Y1 from a discharge port center of the liquid discharge head shown in FIG. 1.

In the liquid discharge head of a plurality of liquid paths-common liquid chamber mode shown in FIGS. 1 to 3, an element substrate 1 is fixed to the top plate 2 via a liquid path side wall 10 in a laminated state, and a liquid flow path 3 whose one end communicates with a discharge port 7 is formed between both plates 1 and 2. A multiplicity of liquid flow paths 3 are disposed on one head. Moreover, with respect to the liquid flow path 3, the element substrate 1 is provided with heat generating members 4*a*, 4*b* as bubble generating means for generating a bubble in a liquid with which the liquid flow path 3 is replenished. The heat generating members 4*a*, 4*b* are disposed on each of the liquid flow paths 3. Additionally, in the present embodiment two heat generating members are disposed in each liquid flow path 3, but the number of the heat generating members disposed in each liquid flow path 3 is not limited to two, and may be more. In a vicinity area of a surface on which the heat generating members 4*a*, 4*b* are in contact with the discharge liquid, a bubble generating area 11 exists in which the heat generating members 4*a*, 4*b* are rapidly heated and bubbling occurs in the discharge liquid.

Each of the multiplicity of liquid flow paths 3 is provided with a liquid supply port 5 formed by a supply section forming member 5A, and a common liquid supply chamber 6 is disposed to communicate with each liquid supply port 5. Specifically, the flow path is branched to a multiplicity of liquid flow paths 3 from the single common liquid supply chamber 6, and an amount of the liquid adapted to the liquid discharged from the supply port 7 communicating with each liquid flow path 3 is received from the common liquid supply chamber 6. Character S denotes a substantial opening area to supply the liquid to the liquid flow path 3 of the liquid supply port 5.

Between the liquid supply port 5 and the liquid flow path 3, a movable member 8 is disposed with a slight gap $\alpha$ (e.g., 10 $\mu$m or less) and substantially parallel to the opening area S of the liquid supply port 5. A projection area of the movable member 8 is larger than the opening area S of the liquid supply port 5 (see FIG. 3), and the side portion of the movable member 8 has a slight gap $\beta$ from each of both flow path side walls 10 (see FIGS. 2, 3).

The aforementioned supply section forming member 5A has a gap $\gamma$ with respect to the movable member 8 as shown in FIG. 2. The gaps $\beta$, $\gamma$ differ with flow path pitches, but the movable member 8 easily shuts off the opening area S with a large gap $\gamma$, and with a large gap $\beta$ the movable member 8 more easily moves to the side of the element substrate 1 with bubble vanishing than in a stationary state in which the member is positioned via the gap $\alpha$. In the present embodiment, the gap $\alpha$ is set to 3 $\mu$m, gap $\beta$ is 3 $\mu$m, and gap $\gamma$ is 4 $\mu$m.

Moreover, the movable member 8 has a width W1 larger than a width W2 of the opening area S in a width direction between the flow path side walls 10, and has a width such that the opening area S is sufficiently sealed. A portion 8A of the movable member 8 defines an upstream side end portion of the opening area of the liquid supply port 5 on an extended line from the end portion on the side of a free end of a continuous portion by which a plurality of movable members are continued with respect to a direction crossing at right angles to a plurality of liquid paths (the continuous portion is partially apart from a fixing member 9 as shown in FIG. 1) (see FIG. 3). In the present embodiment, as shown in FIGS. 3 and 2, a portion of the supply section forming member 5A along the movable member 8 is set to be thinner than the liquid flow path side wall 10 itself, and the supply section forming member 5A is laminated with respect to the flow path wall 10. Additionally, a thickness of the supply section forming member 5A on the side of the discharge port 7 from a free end 8B of the movable member is set to the same thickness as that of the liquid flow path wall 10 itself as shown in FIG. 3.

Therefore, the movable member 8 can move in the liquid flow path 3 without any frictional resistance, and displacement toward the opening area S can be restricted in a peripheral portion of the opening area S. Thereby, the opening area S is substantially closed so that a liquid flow to the common liquid supply chamber 6 from the inside of the liquid flow path 3 can be prevented, while with bubble vanishing, movement is possible from a substantially sealed state to a refill possible state on the side of the liquid flow path. Moreover, in the present embodiment, the movable member 8 is also positioned parallel to the element substrate 1. Furthermore, the end 8B of the movable member 8 is a free end positioned on the vicinity of the heat generating members 4*a*, 4*b* of the element substrate 1, and the other end is supported by the fixing member 9. Moreover, the fixing member 9 closes an end portion (i.e., an upstream side end portion) on the side of the liquid flow path 3 opposite to the discharge port 7 of the movable member 8.

Figure 4:
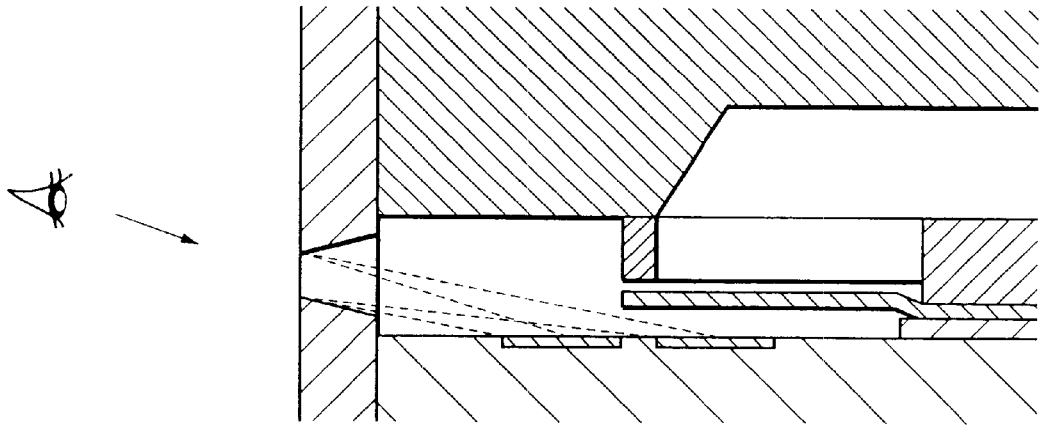
FIG. 4 is a sectional view of the flow path showing "linear communication state".

Additionally, as shown in FIG. 4, in the present embodiment, there is no obstacle like a valve between the heat generating members 4*a*, 4*b* as the electrothermal converting element and the discharge port 7, and a "linear communication state" is obtained in which a linear flow path structure is kept with respect to the liquid flow. In this case, more preferably, by linearly placing a propagation direction of a pressure wave generated during bubble generation and a liquid flow direction in agreement with a liquid discharge direction, an ideal state is preferably formed in which a discharge direction, discharge speed and another discharge state of a discharge droplet are stabilized with a considerably high level. In the present invention, as one definition for achieving or approximating the ideal state, the discharge port 7 may directly linearly be connected to the heat generating members 4*a*, 4*b*, particularly the discharge port side (downstream side) of the heat generating member which exerts an influence on the bubble discharge port side in a constitution. This is a state with no fluid in the flow path, in which the heat generating member, particularly the downstream side of the heat generating member can be observed from the outside of the discharge port 7 (see FIG. 4).

A discharge operation of the liquid discharge head of the present embodiment will next be described in detail. FIGS. 5A to 5D and FIGS. 6A to 6C are explanatory views of the discharge operation of the liquid discharge head with a structure shown in FIGS. 1 to 3, showing the liquid discharge head in a view cut along a liquid flow path direction, and showing a characteristic phenomenon in divided processes of FIGS. 5A to 5D and FIGS. 6A to 6C. Moreover, in FIGS. 5A to 5D and FIGS. 6A to 6C, character M denotes a meniscus formed by the discharged liquid. Additionally, FIGS. 5A to 5D and FIGS. 6A to 6C shown an example in which the front-side (downstream-side) heat generating member 4*a* is heated.

Figure 5A:
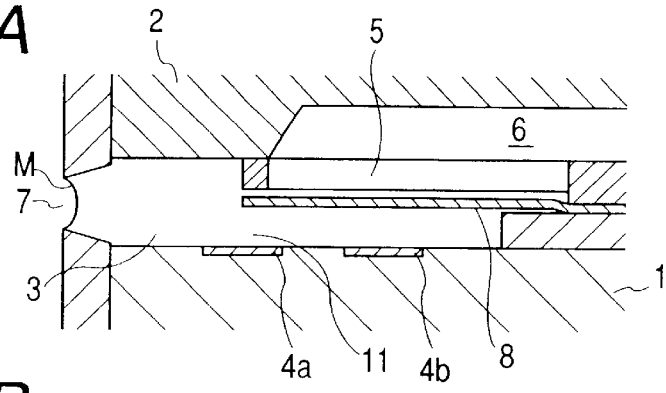
FIGS. 5A, 5B, 5C and 5D are explanatory views of a discharge operation of the liquid discharge head with a structure shown in FIGS. 1, 2 and 3.

FIG. 5A shows a state before an electric energy or another energy is applied to the heat generating member 4, and a state before the heat generating member generates heat. In this state, a slight gap (10 $\mu$m or less) exists between the movable member 8 disposed between the liquid supply port 5 and the liquid flow path 3, and a forming surface of the liquid supply port 5.

Figure 5B:
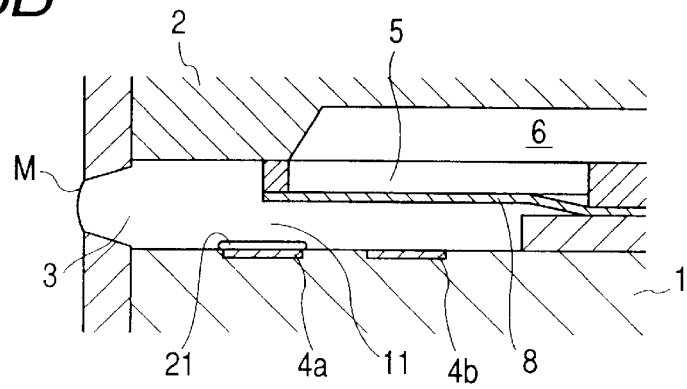

FIG. 5B shows that a part of the liquid in the liquid flow path 3 is heated by the heat generating member 4*a*, film boiling occurs on the heat generating member 4*a*, and a bubble 21 isotropically grows. Here, "the bubble growth is isotropic" means that a bubble growth speed directed in a perpendicular direction of a bubble surface has a substantially equal magnitude in some places of the bubble surface.

In the isotropic growth process of the bubble 21 in an initial stage of bubble generation, the movable member 8 closely abuts on the peripheral portion of the liquid supply port 5 to close the liquid supply port 5, and the inside of the liquid flow path 3 is substantially in a sealed state except the discharge port 7. This sealed state is maintained in any period in the isotropic growth process of the bubble 21. Additionally, the period for setting the sealed state may be between when an electric energy is applied to the heat generating member 4 and when the isotropic growth process of the bubble 21 ends. Moreover, in this sealed state, inertance (difficulty in movement when a still liquid rapidly starts moving) from a center of the heat generating member 4 to the liquid supply port side in the liquid flow path 3 substantially becomes infinite. In this case, the inertance from the heat generating member 4 to the liquid supply port side approaches infinity when more distance is obtained between the heat generating member 4 and the movable member 8.

Figure 5C:
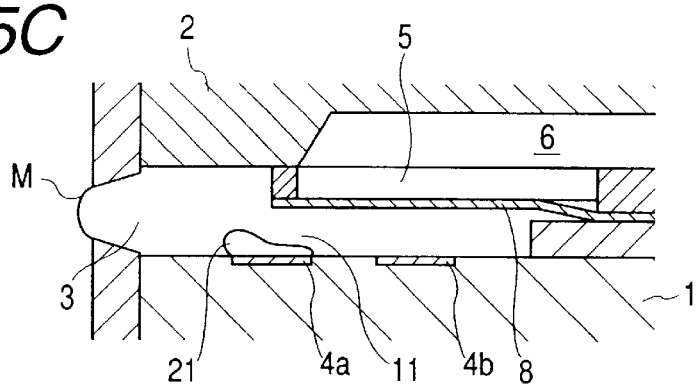

FIG. 5C shows that the bubble 21 continues to grow. As described above, when the liquid flow path 3 is substantially placed in the sealed state excluding the discharge port 7, no liquid flow goes to the liquid supply port 5 side. Therefore, among the bubbles isotropically grown on the heat generating member 4*a*, the bubble on the liquid supply port 5 side cannot grow, and the bubble growth energy is consumed only in the bubble growth on the discharge port 7 side.

Figure 7A:
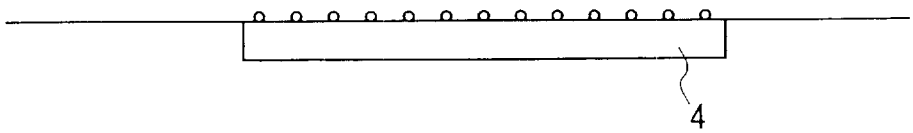
FIGS. 7A, 7B, 7C, 7D and 7E are views of an isotropic growth state of a bubble of FIG. 5B.
Figure 7B:
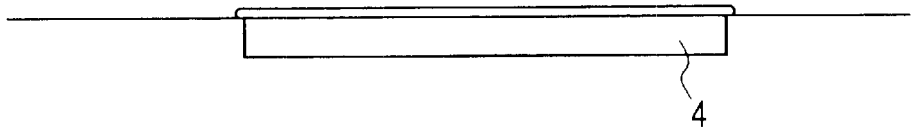
Figure 7C:
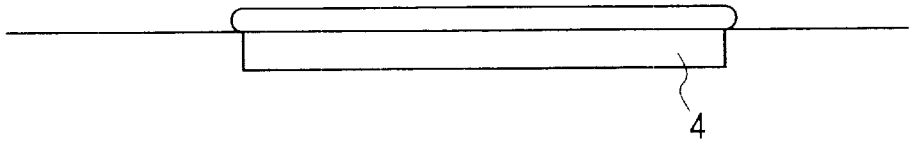
Figure 7D:
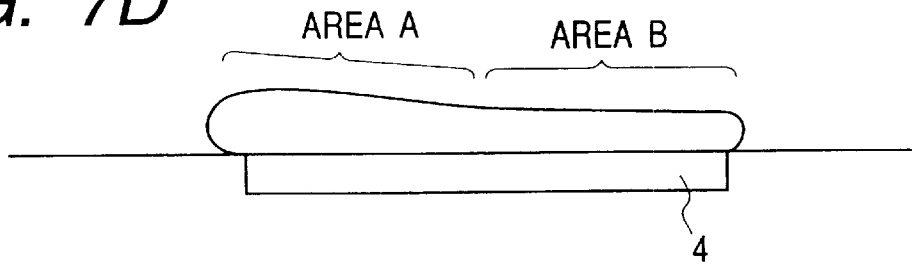
Figure 7E:
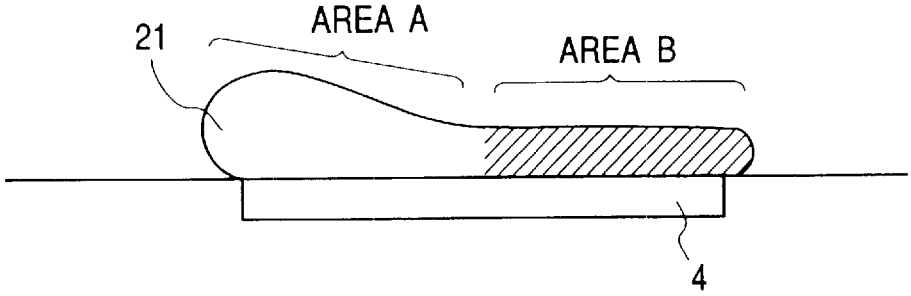

Here, the bubble growth process in FIGS. 5A to 5C will be described in detail with reference to FIGS. 7A to 7E. As shown in FIG. 7A, initial boiling occurs on the heat generating member 4 when the heat generating member 4 is heated, and subsequently as shown in FIG. 7B, the boiling changes to a film boiling in which the heat generating member 4 is covered with the film-like bubble. Moreover, the bubble in a film boiling state continues to isotropically grow as shown in FIGS. 7B and 7C (this isotropic bubble growth state is called a semi-pillow state). Additionally, when the inside of the liquid flow path 3 is substantially in the sealed state excluding the discharge port 7 as shown in FIG. 5B, liquid movement to the upstream side becomes impossible, a part of the bubble on the upstream side (liquid supply port side) in the semi-pillow bubble fails to grow, and only a remaining portion on the downstream side (discharge port side) grows. This state is shown in FIGS. 5C, 7D, 7E.

For the sake of convenience in description, when the heat generating member 4*a* is heated, an area in which no bubble grows on the heat generating member 4*a* is referred to as an area B, and an area on the side of the discharge port 7 in which the bubble grows is referred to as an area A. Additionally, a bubbling volume during the isotropic bubble growth is maximized in the area B.

Figure 5D:
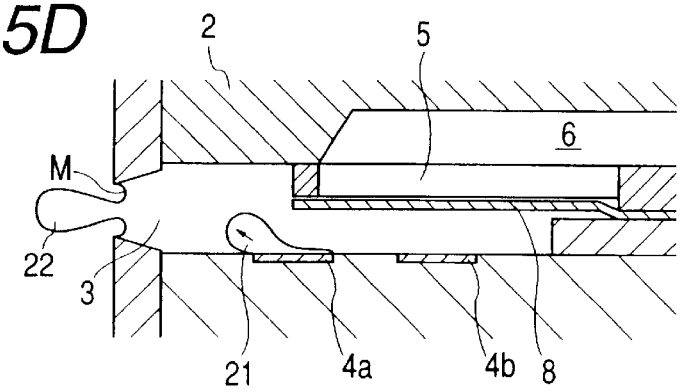

Next FIG. 5D shows that the bubble growth continues in the area A, and bubble shrinkage starts in the area B. In this state, the bubble largely grows toward the discharge port side in the area A. Moreover, the bubble volume in the area B starts to decrease. Thereby, the movable member 8 starts to be displaced downward to a stationary state position in accordance with its restoring force by rigidity and bubble vanishing force in the area B. As a result, the liquid supply port 5 opens, and the common liquid supply chamber 6 is placed in the communication state with the liquid flow path 3.

Figure 6A:
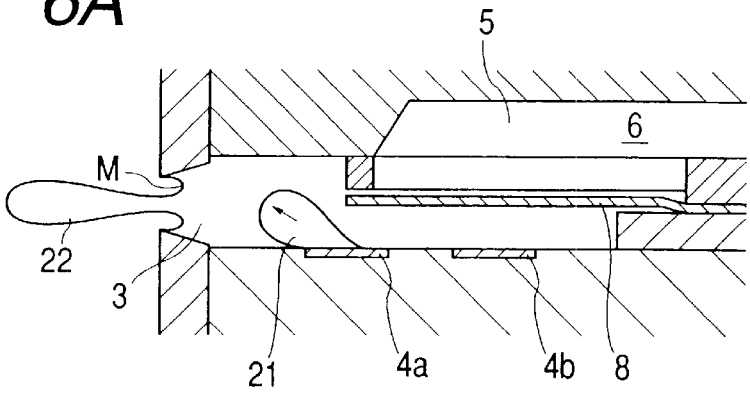
FIGS. 6A, 6B and 6C are explanatory views of the discharge operation of the liquid discharge head with the structure shown in FIGS. 1, 2 and 3.

FIG. 6A shows that the bubble 21 has grown substantially to maximum. In this state, the bubble grows to the maximum in the area A, and accordingly the bubble substantially vanishes in the area B. Moreover, a discharge droplet 22 which is to be discharged from the discharge port 7 trails long and is still connected to the meniscus M. As shown in the drawing, a maximum bubbling volume of the bubble is Vo.

Figure 6B:
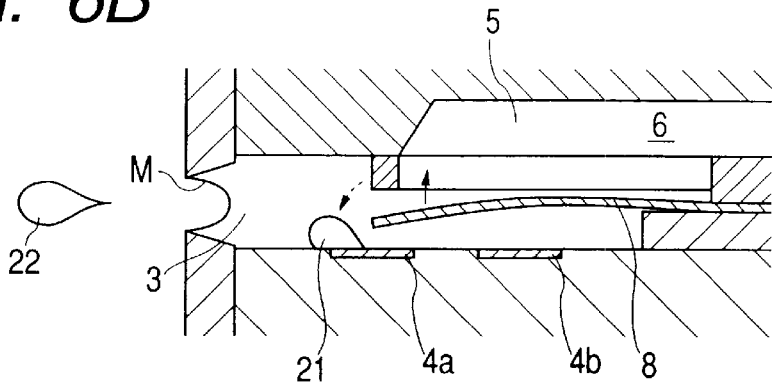

FIG. 6B shows that the bubble 21 stops growing and is in a stage only of a bubble vanishing process, and the discharge droplet 22 is cut from the meniscus M. Immediately after the bubble growth changes to bubble vanishing in the area A, a shrinkage energy of the bubble 21 acts as a force for moving the liquid in the vicinity of the discharge port 7 in an upstream direction as an entire balance. Therefore, the meniscus M is drawn into the liquid flow path 3 from the discharge port 7 at this point of time, and a liquid column connected to the discharge liquid droplet 22 is cut off by a strong force. On the other hand, the movable member 8 is displaced downward with bubble shrinkage, and the liquid rapidly flows as a large flow into the liquid flow path 3 from the common liquid supply chamber 6 via the liquid supply port 5. Thereby, since the flow for rapidly drawing the meniscus M into the liquid flow path 3 is rapidly reduced, the retreat amount of the meniscus M decreases, and the meniscus M starts returning to the position before bubbling with a relatively low speed. As a result, a converging property of vibration of the meniscus M is very satisfactory as compared with the liquid discharge system which is not provided with the movable member of the present invention.

Figure 6C:
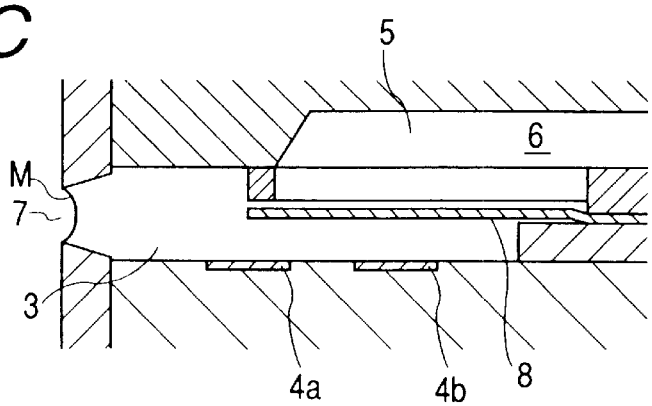

FIG. 6C shows that the bubble 21 completely vanishes, and the movable member 8 also returns to the stationary state position. The movable member 8 is displaced upward to this state by its elastic force (a direction of a solid-line arrow of FIG. 6B). Moreover, in this state, the meniscus M already returns to the vicinity of the discharge port 7.

Figure 8:
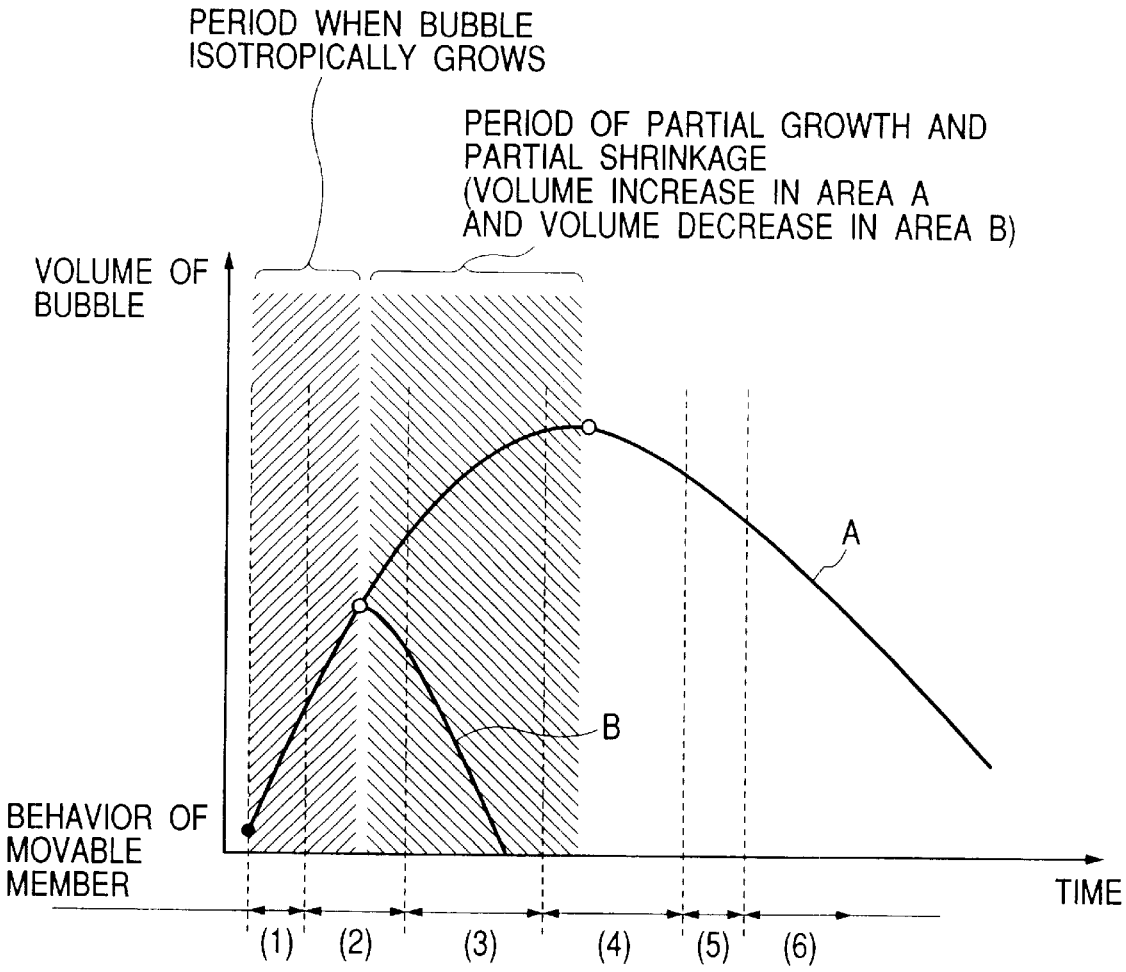
FIG. 8 is a graph showing a correlation between a change of bubble growth with time in areas A and B shown in FIG. 4 and a behavior of a movable member.

A correlation between a change of bubble volume with time in areas A and B shown in FIGS. 5A to 5D and FIGS. 6A to 6C and a behavior of the movable member will next be described with reference to FIG. 8. FIG. 8 is a graph showing the correlation, curve A shows the change of bubble volume with time in the area A, and curve B shows the change of bubble volume with time in the area B.

As shown in FIG. 8, the change of bubble growth volume with time in the area A draws a parabola having a maximum value. Specifically, the bubble volume increases with an elapse of time from the start of bubbling until the bubble vanishing, reaches the maximum at a certain point of time, and subsequently decreases. On the other hand, with respect to the area B, as compared with the area A, time required from the start of bubbling until the bubble vanishing is short, the maximum growth volume of the bubble is small, and time until the growth volume reaches the maximum is also short. Specifically, the area A is largely different from the area B in the time required from the bubbling start until the bubble vanishing and the bubble growth volume change, and those of the area B are smaller.

Particularly in FIG. 8, since the bubble volume increases with the same time change in the initial stage of the bubble generation, the curve A is superposed on the curve B. Specifically, a period when the bubble isotropically grows (in the semi-puro state) is generated in the initial stage of the bubble generation. Thereafter, the curve A draws a curve to increase to a maximum point, but the curve B is branched from the curve A at the certain point of time to draw a curve along which the bubble volume decreases. Specifically, a period when the bubble volume increases in the area A, but decreases in the area B (a period of partial growth and partial shrinkage) is generated.

Furthermore, in a mode in which a part of the heat generating member is covered with the free end of the movable member based on the aforementioned way of bubble growth as shown in FIG. 1, the movable member provides the following behavior. Specifically, the movable member is displaced upward toward the liquid supply port in a period (1) of FIG. 8. In a period (2) of FIG. 8 the movable member closely abuts on the liquid supply port, and the inside of the liquid flow path is substantially in the sealed state excluding the discharge port. The sealed state is started in the period when the bubble isotropically grows. Next in a period (3) of FIG. 8, the movable member is displaced downward toward the stationary state position. The opening of the liquid supply port by the movable member is started after a fixed time elapses after the start of the period of partial growth and partial shrinkage. Subsequently in a period (4) of FIG. 8, the movable member is further displaced downward from the stationary state. Next in a period (5) of FIG. 8, the downward displacement of the movable member substantially stops, and the movable member is in an equilibrium state in its opened position. Finally in a period (6) of FIG. 8, the movable member is displaced upward toward the stationary state position.

The correlation between the bubble growth and the movable member behavior is influenced by the relative positions of the movable member and heat generating member. Here, the correlation between the bubble growth and the movable member behavior in the liquid discharge head provided with the movable member and heat generating member in relative positions different from the positions in the present mode will next be described with reference to FIGS. 9A and 9B and FIGS. 10A and 10B.

Figure 9A:
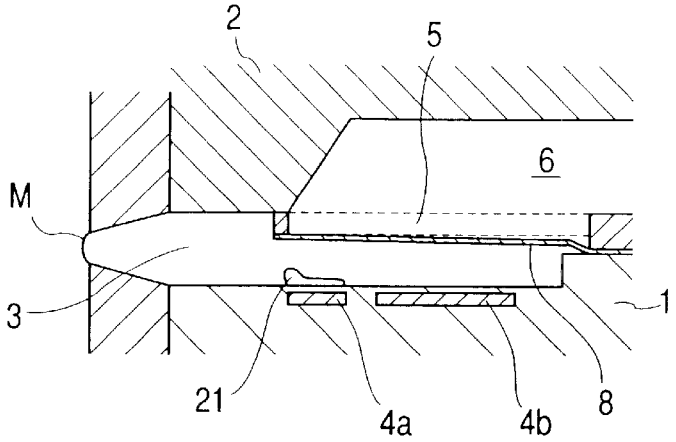
FIG. 9A is a view of the liquid discharge head with a relative position between the movable member and a heat generating member different from the relative position shown in FIG. 1.
Figure 9B:
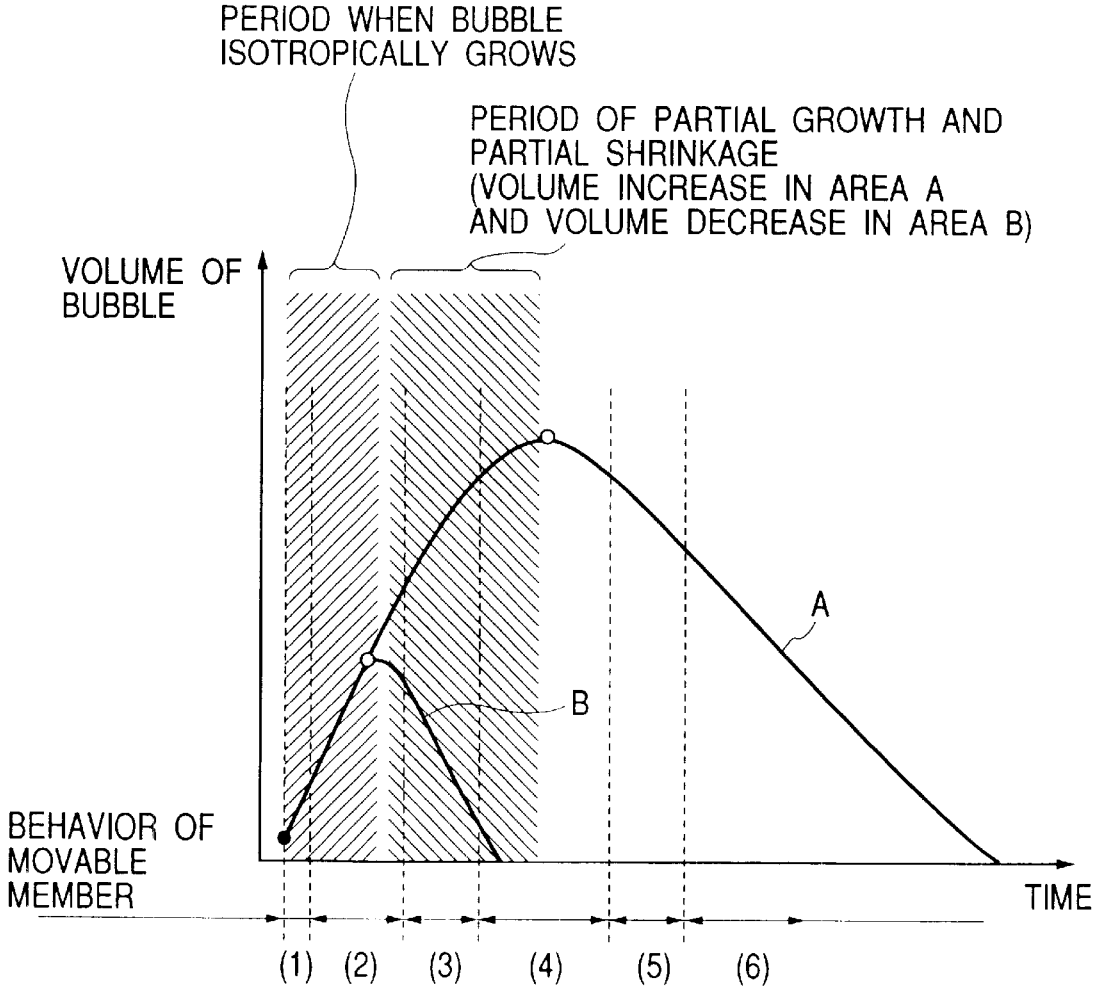
FIG. 9B is a graph showing the correlation between the change of bubble growth with time and the behavior of the movable member.

FIGS. 9A and 9B are explanatory views of the correlation between the bubble growth and the movable member behavior in a mode in which the entire heat generating member is covered with the free end of the movable member, FIG. 9A shows the mode, and FIG. 9B is a graph of the correlation. When an area of the heat generating member 4*a* covered with the movable member 8 is large as shown by the mode of FIG. 9A, period (1) of FIG. 9B is short time as compared with the mode of FIG. 1, and more preferably the heat generating member is placed in the sealed state in a short time after being heated. Additionally, the behaviors of the movable member in respective periods (1) to (6) of FIG. 9B are the same as the behaviors described with reference to FIG. 8. Moreover, in the mode of FIGS. 9A and 9B, since the movable member 8 is easily influenced by the bubble volume decrease, as seen from a start point of period (3) of FIG. 9B, the opening of the liquid supply port 5 by the movable member 8 is started immediately after the start of the period of partial growth and partial shrinkage. Specifically, the opening timing of the movable member 8 is fast as compared with the mode of FIG. 1. For similar reasons, an amplitude of movable member 8 is enlarged.

Figure 10A:
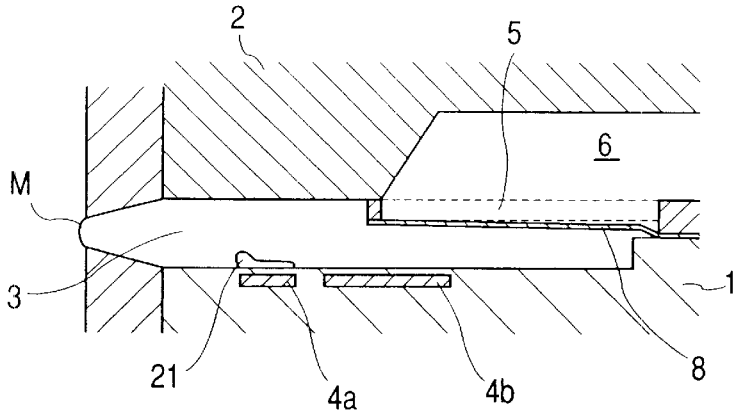
FIG. 10A is a view of the liquid discharge head with the relative position between the movable member and the heat generating member different from the relative position shown in FIG. 1.
Figure 10B:
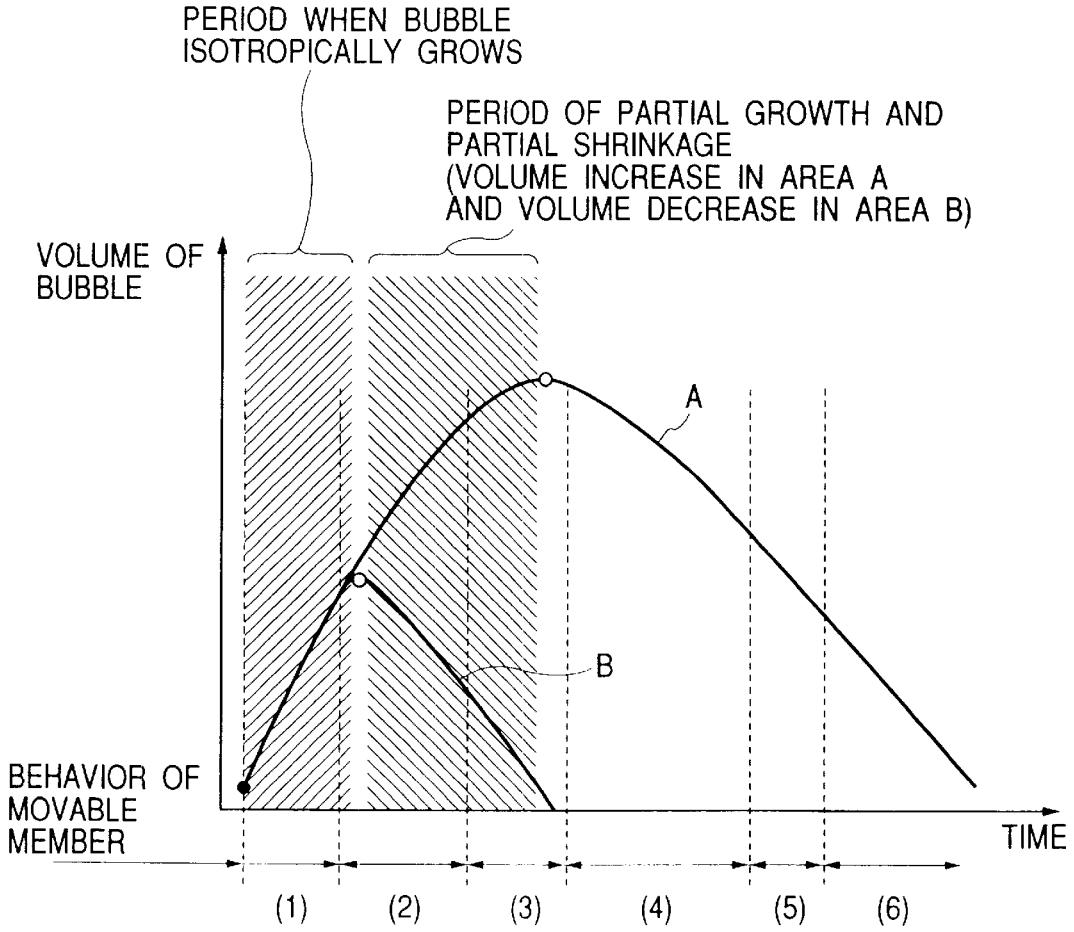
FIG. 10B is a graph showing the correlation between the change of bubble growth with time and the movable member behavior.

FIGS. 10A and 10B are explanatory views of the correlation between the bubble growth and the movable member behavior in a mode in which the heat generating member is apart from the movable member, FIG. 10A shows the mode, and FIG. 10B is a graph of the correlation. When the heat generating member 4*a* is positioned on the side of the discharge port from a position below the free end of the movable member 8 as shown by the mode of FIG. 10A, the movable member 8 is not easily influenced by the bubble volume decrease, and as seen from the start point of period (3) of FIG. 10B, the opening of the liquid supply port 5 by the movable member 8 is started considerably later from the start of the period of partial growth and partial shrinkage. Specifically, the opening timing of the movable member 8 is slow as compared with the mode of FIG. 1. For similar reasons, the amplitude of the movable member 8 is reduced. Additionally, the behaviors of the movable member in respective periods (1) to (6) of FIG. 10B are the same as the behaviors described with reference to FIG. 8.

Additionally, for the position relation between the movable member 8 and the heat generating member 4*a* the general operation has been described, and respective operations differ with the position of the movable member, the rigidity of the movable member, and the like.

The head constitution and liquid discharge operation of the present embodiment have been described above, and according to the mode, growth components to downstream and upstream sides of the bubble are not uniform, most of the growth components toward the upstream side are eliminated and the movement of the liquid to the upstream side is inhibited. Since the liquid flow to the upstream side is inhibited, most of the bubble growth components on the upstream side are directed toward the discharge port without any loss, and discharge force is considerably enhanced. Furthermore, the retreat amount of meniscus after the discharge decreases, and accordingly an amount of the meniscus protruded from an orifice surface during refill also decreases. Therefore, meniscus vibration is inhibited, and stable discharge can be performed in any drive frequency from a low frequency to a high frequency.

Additionally, the case in which the heat generating member 4*a* on the downstream side of the liquid flow path 3 is heated has been described above, but the aforementioned discharge operation similarly occurs even when the heat generating member 4*b* on the upstream side is heated. This is because as described later in the present invention the upstream side heat generating member 4*b* is larger than the downstream side heat generating member 4*a* in effective discharge area, and with a constitution in which the movable member 8 closely abuts on the liquid supply port 5 in the isotropic growth process of the bubble generated during heating of the downstream side heat generating member 4*a*, the movable member 8 similarly abuts on the liquid supply port 5 even during heating of the upstream side heat generating member 4*b*.

As described above, according to the liquid discharge head of the present embodiment, a part of the liquid with which the liquid flow path 3 is filled is heated by the heat generating member 4, bubbling occurs with film boiling, then a pressure wave is generated by bubble generation, simultaneously the movable member 8 closely abuts on the peripheral portion of the liquid supply port 5 to close the liquid supply port 5, and the inside of the liquid flow path 3 is substantially placed in a sealed state excluding the discharge port 7. Therefore, the pressure wave is inhibited from being propagated to the side of the liquid supply port 5. Therefore, in the liquid discharge head of the present embodiment, since no ink moves to the back of the heat generating member during liquid discharge, it can be considered that a flow resistance behind the heat generating member is substantially infinite.

Therefore, among three elements for determining a liquid discharge property of the liquid discharge head: (1) flow resistance before the heat generating member (on the downstream side); (2) flow resistance behind the heat generating member (on the upstream side); and (3) a ratio of the flow resistance before the heat generating member to the flow resistance behind the heat generating member, (2) the flow resistance behind the heat generating member (on the upstream side) becomes infinite, and (3) the ratio of the flow resistance before the heat generating member to the flow resistance behind the heat generating member therefore always becomes zero even with a change of the flow resistance before the heat generating member (on the downstream side) because of the infinite flow resistance behind the heat generating member (on the upstream side). Therefore, the liquid discharge property of the liquid discharge head of the present embodiment is determined only by (1) the flow resistance before the heat generating member (on the downstream side).

Figure 11A:
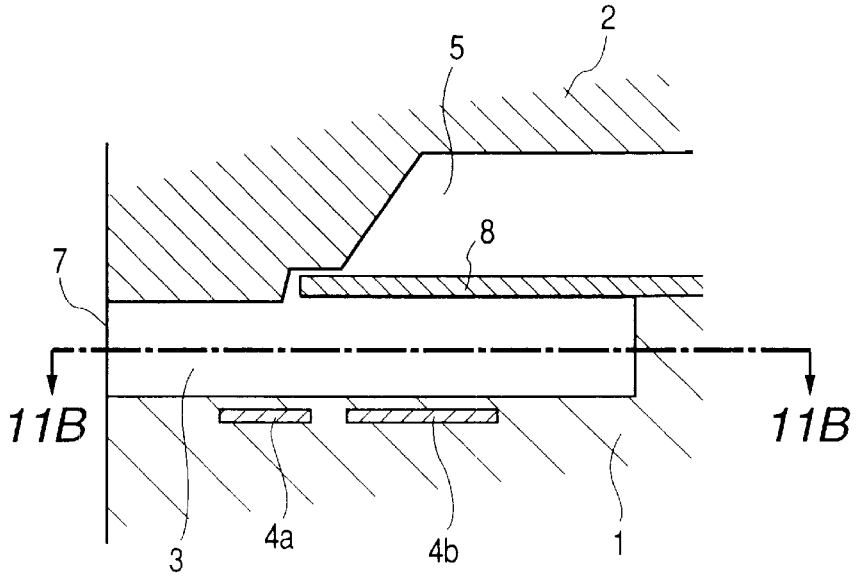
FIGS. 11A and 11B are sectional views of an example in which a sectional area of a liquid flow path (nozzle) of the liquid discharge head of the present invention is constant over the entire length.
Figure 11B:
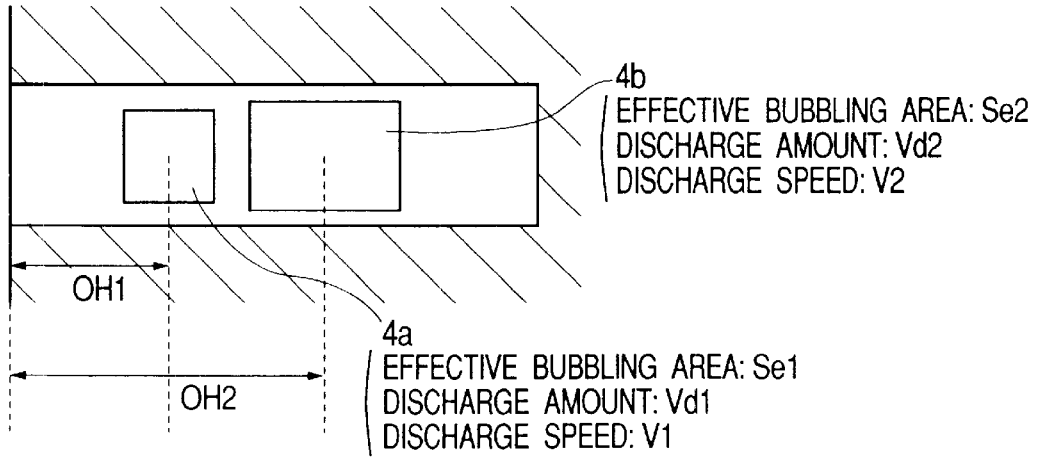

Here, a case will be described with reference to FIGS. 11A and 11B, in which a sectional area of the liquid flow path 3 (nozzle) is constant over the entire length. Additionally, FIG. 11A is a sectional view along one liquid flow path direction of the liquid discharge head, and FIG. 11B is a sectional view along an 11B—11B line of FIG. 11A.

A maximum bubbling volume Vo is proportional to a pressure generated on the heat generating member during bubbling. When a nozzle constitution does not largely differ, the bubbling pressure is substantially proportional to an effective bubbling area Se of the heat generating member. Additionally, an area about 4 $\mu$m apart from an outer edge of the heat generating member fails to reach a high temperature and fails to contribute to bubbling even by passing a current, and the effective bubbling area Se therefore corresponds to an area obtained by subtracting an area of an outer edge portion from the entire area of the heat generating member.

Furthermore, in the present embodiment, since no liquid moves to the back of the heat generating member, on bubbling, substantially all the liquid moves in a direction of the discharge port, the bubble maximum bubbling volume Vo substantially becomes equal to a discharge amount Vd. Specifically, the discharge amount Vd is proportional to the effective discharge area Se, and the following equation is obtained.

$$Vd=a\cdot Se \text{ (a is a proportionality constant)} \qquad \text{Equation (1)}$$

Moreover, the discharge speed v of the liquid droplet is determined by an acceleration of movement of the liquid to the front of the heat generating member. Therefore, the discharge speed v is proportional to a bubbling power determined by the effective discharge area Se of the heat generating member, and inversely proportional to a forward flow resistance Rf of the heat generating member. Therefore, the discharge speed v is given by the following equation.

$$v=b\cdot Se/Rf \text{ (b is a proportionality constant)} \qquad \text{Equation (2)}$$

Here, the equation (1) is substituted in the equation (2), the following equation is obtained.

$$v=c\cdot Vd/Rf \text{ (c=b/a)} \qquad \text{Equation (3)}$$

Additionally, the flow resistance Rf is obtained by integrating a reciprocal of a nozzle sectional area over a distance to the front of the heat generating member from the discharge port, and is given by the following equation.

$$Rf=\int[\rho/S(x)]dx=[\rho/S]\cdot OH \qquad \text{Equation (4)}$$

Here, ρ denotes a liquid density, S(x) denotes the nozzle sectional area in position x, and OH denotes a distance to the gravity center of the heat generating member from the discharge port. It is seen from the above equation (4) that when the nozzle sectional area is constant (S), the flow resistance Rf is proportional to the distance OH to the gravity center of the heat generating member from the discharge port.

It is seen from the equations (3) and (4) that the following equation is obtained, and it is seen from the result that the discharge speed v is easily obtained from the discharge amount Vd and the distance OH.

$$v=c\cdot Vd/OH \text{ (c'=c·S/ρ)} \qquad \text{Equation (5)}$$

In the liquid discharge head in which two heat generating members are disposed for one nozzle as in the present embodiment, when the liquid is discharged from the same nozzle by a discharge amount Vdl by the first heat generating member 4*a* and a discharge amount Vd2 by the second heat generating member 4*b*, and the arrangement position of the heat generating member is determined so that the following equation is obtained, with respect to discharge speeds v1, v2 of the liquid droplets discharged by the respective heat generating members, a relation of v1=v2 is established.

$$Vd1/Vd2=OH1/OH2 \qquad \text{Equation (6)}$$

For example, when the discharge amount ratio of the liquid droplet is set to 1:4, by setting a ratio of the effective discharge area of the first heat generating member 4*a* to that of the second heat generating member 4*b* to 1:4, and setting a ratio of a distance between the discharge port and the first heat generating member 4*a* to the distance between the discharge port and the second heat generating member 4*b* to 1:4, the discharge speed v1 of the small liquid droplet can be set to be equal to the discharge speed v2 of the large liquid droplet.

A case will next be described with reference to FIGS. 12A and 12B, in which the sectional area of the liquid flow path 3 (nozzle) changes with respect to a length direction. Additionally, FIG. 12A is a sectional view along one liquid flow path direction of the liquid discharge head, and FIG. 12B is a sectional view along a 12B—12B line of FIG. 12A.

Figure 12A:
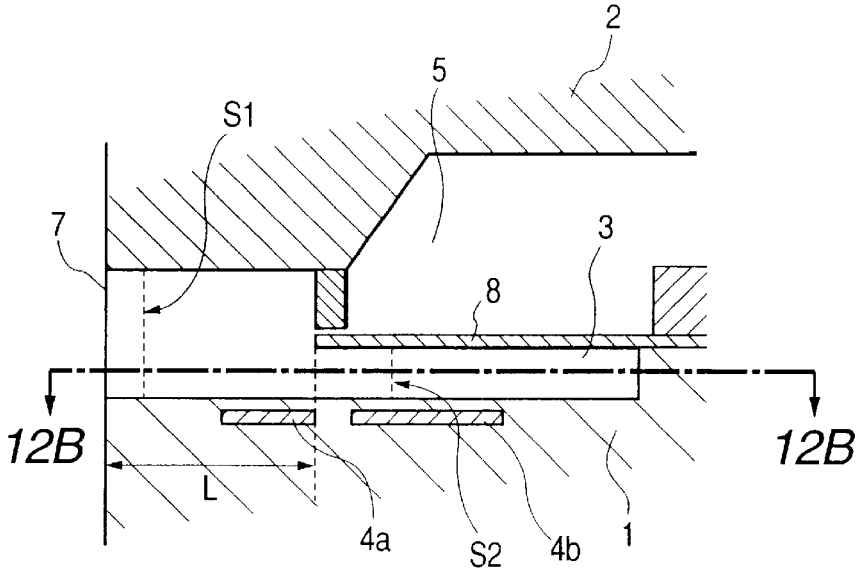
FIGS. 12A and 12B are sectional views of an example in which the sectional area of the liquid flow path (nozzle) of the liquid discharge head of the present invention is constant in a length direction.
Figure 12B:
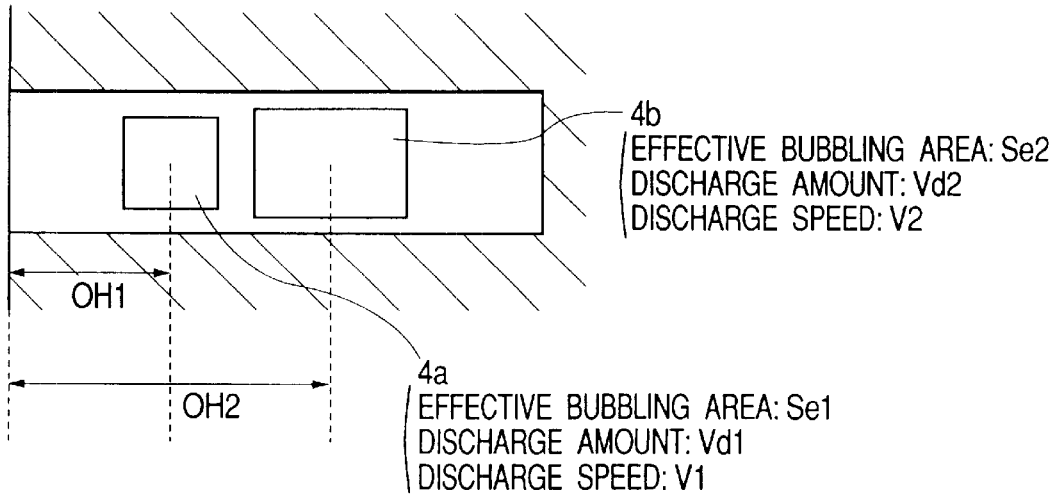

The liquid flow path 3 of the liquid discharge head shown in FIGS. 12A and 12B are shown using a position of a distance L from the discharge port 7 as a boundary, a sectional area on the downstream side from the position is S1, and the sectional area on the upstream side is S2.

Also in the example shown in FIGS. 12A and 12B, when an effective discharge area of the first heat generating member 4*a* is Sel, a discharge amount is Vdl, a discharge speed is v1, and a flow resistance of the liquid flow path 3 in an area with a sectional area of S1 is Rf1, the following equations are obtained.

$$Vd1=a\cdot Se1 \text{ (a is a proportionality constant)} \quad \text{Equation (7)}$$

$$v1=b\cdot Se1/Rf1 \text{ (b is a proportionality constant)} \quad \text{Equation (8)}$$

$$v1=c\cdot Vd1/Rf1 \text{ (c=b/a)} \quad \text{Equation (9)}$$

$$Rf1=[\rho/S1]\cdot OH1 \quad \text{Equation (10)}$$

$$v1=c'\cdot Vd1/OH1 \text{ (c'=c·S1/ρ)} \quad \text{Equation (11)}$$

Moreover, when the effective discharge area of the second heat generating member 4*b* is Se2, the discharge amount is Vd2, the discharge speed is v2, and the flow resistance of the liquid flow path 3 in an area with a sectional area of S2 is Rf2, the following equations are obtained.

$$Vd2=a\cdot Se2 \text{ (a is a proportionality constant)} \quad \text{Equation (12)}$$

$$v2=b\cdot Se2/Rf2 \text{ (b is a proportionality constant)} \quad \text{Equation (13)}$$

$$v2=c\cdot Vd2/Rf2 \text{ (c=b/a)} \quad \text{Equation (14)}$$

$$Rf2=[\rho/S1]\cdot L+[\rho/S2]\cdot(OH2-L) \quad \text{Equation (15)}$$

$$v2=c'\cdot Vd2\cdot(L/S1+(OH2-L)/S2)-1 \quad \text{Equation (16)}$$

Here, when OH1<L<OH2, by setting respective values to obtain the following equation:

$$Se1\cdot(S1/OH1)=Se2\cdot(L/S1+(OH2-L)/S2)-1,$$

v1=v2 is obtained, and the discharge speeds of the small and large liquid droplets discharged by the heat generated by the respective heat generating members 4*a*, 4*b* can be equal to each other.

Moreover, for a liquid discharge operation mode by the liquid discharge head of the present invention, there are a mode for driving either one of the respective heat generating members 4*a*, 4*b*, and a mode for driving both the heat generating members 4*a*, 4*b*. In the mode for driving both the heat generating members 4*a*, 4*b*, a discharge state differs from that of the mode for driving either one of the respective heat generating members 4*a*, 4*b*.

The mode for driving both the heat generating members 4*a*, 4*b* includes a mode for simultaneously driving both the heat generating members 4*a*, 4*b*, a mode for first driving the heat generating member 4*a* on the downstream side and a mode for first driving the heat generating member 4*b* on the upstream side. In the mode for simultaneously driving both the heat generating members 4*a*, 4*b*, the discharge amount becomes less than the total discharge amount in the mode of individually driving the respective heat generating members 4*a*, 4*b*. Moreover, in the mode of first driving the downstream-side heat generating member 4*a*, while the liquid flow path 3 is substantially in the sealed state excluding the discharge port, the downstream-side heat generating member 4*a* can be driven twice. Thereby, the discharge amount becomes larger than that in the mode of discharging two liquid droplets and simultaneously driving both the heat generating members 4*a*, 4*b*. Moreover, in the mode of first driving the upstream-side heat generating member 4*a*, the movable member can more quickly be displaced downward than in the mode of simultaneously driving both the heat generating members 4*a*, 4*b*, and therefore a refill property can further be enhanced.

A discharge state in the mode of driving both the heat generating members 4*a*, 4*b* will successively be described hereinafter with reference to the drawings.

Figure 18A:
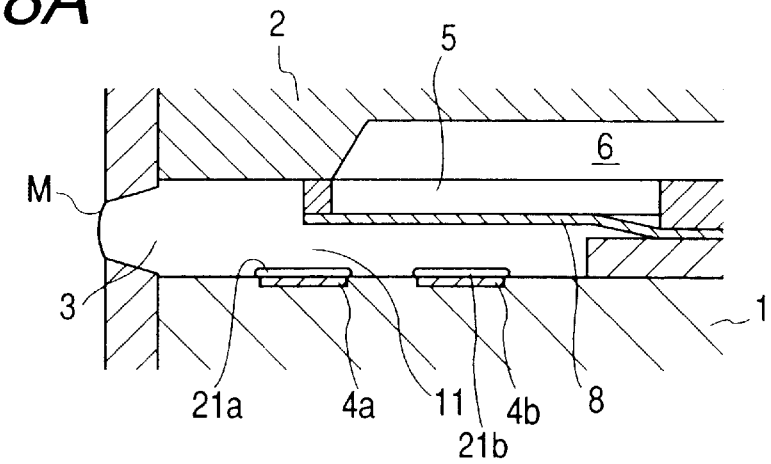
FIGS. 18A, 18B and 18C are explanatory views of the discharge operation of the liquid discharge head with the structure shown in FIGS. 1, 2 and 3.
Figure 18B:
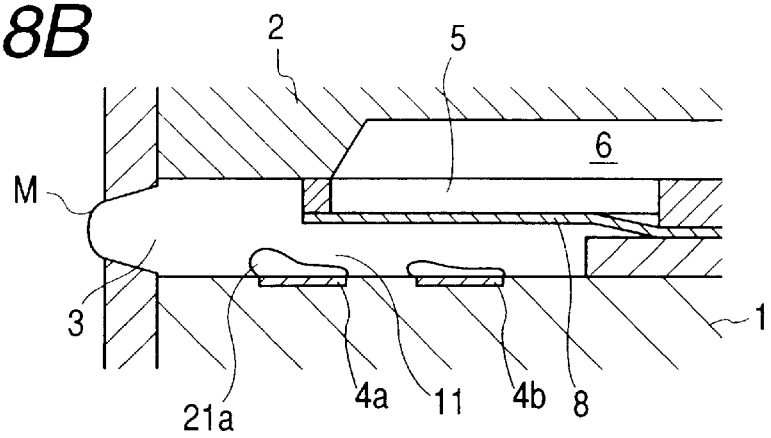
Figure 18C:
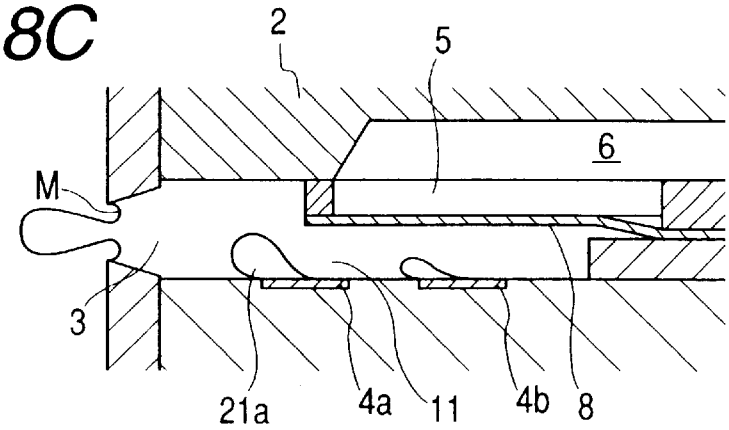
Figure 19A:
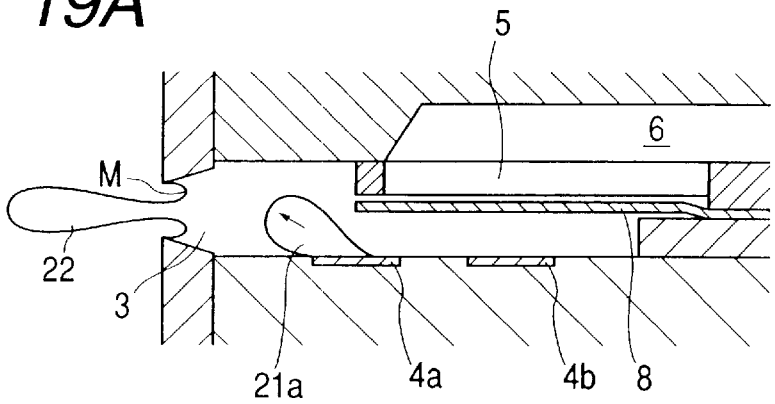
FIGS. 19A, 19B and 19C are explanatory views of the discharge operation of the liquid discharge head with the structure shown in FIGS. 1, 2 and 3.
Figure 19B:
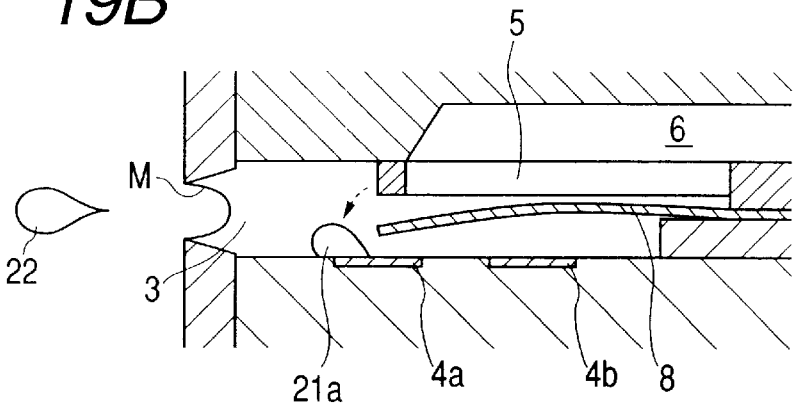
Figure 19C:
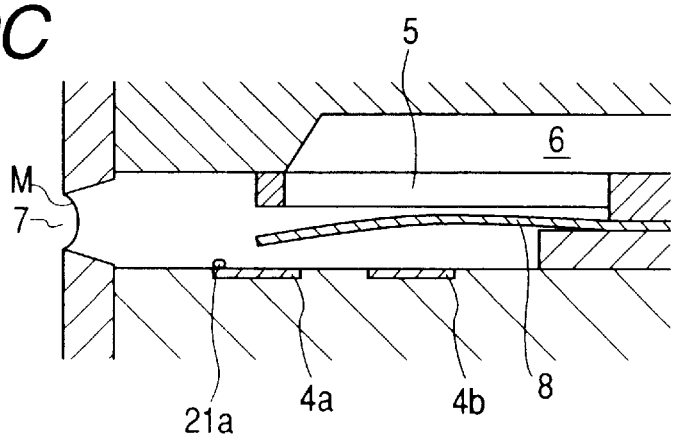

First, a liquid droplet discharge operation in the mode for simultaneously driving both the heat generating members 4*a*, 4*b* will be described. FIGS. 18 and 19 show a characteristic phenomenon of the liquid droplet discharge operation in the mode of simultaneously driving both the heat generating members 4*a*, 4*b* in divided processes of FIGS. 18A to 18C and FIGS. 19A to 19C.

FIG. 18A shows that by simultaneously driving both the heat generating members 4*a*, 4*b*, a part of the liquid to fill the liquid flow path 3 is heated by both the heat generating members 4*a*, 4*b*, film boiling occurs on both the heat generating members 4*a*, 4*b* and bubbles 21*a*, 21*b* isotropically grow. Here, "bubble growth is isotropic" means that bubble growth speeds in a perpendicular direction of a bubble surface are substantially equal to one another in any position of the bubble surface.

In the isotropic growth process of the bubbles 21*a*, 21*b* in the initial stage of bubble generation, the movable member 8 closely abuts on the peripheral portion of the liquid supply port 5 to close the liquid supply port 5, and the inside of the liquid flow path 3 is substantially in the sealed state excluding the discharge port 7.

FIG. 18B shows that the bubbles 21*a*, 21*b* continue to grow. In this case, as compared with the driving of only the downstream-side heat generating member 4*a*, the bubble in the area A on the downstream-side heat generating member 4*a* grows fast, and the bubble in the area B shrinks fast. Specifically, the bubble 21*a* on the downstream-side heat generating member 4*a* shifts fast to a period of partial growth and partial shrinkage. Moreover, the bubbling voltage of the bubble 21*b* on the upstream-side heat generating member 4*b* is small.

FIG. 18C shows that the bubble growth continues in the area A of the respective bubbles 21*a*, 21*b* on both heat generating members 4*a*, 4*b*, and bubble shrinkage starts in the area B. In this state, the bubbles 21*a*, 21*b* largely grow toward the discharge port side in the area A. Moreover, the volumes of the bubbles 21*a*, 21*b* in the area B starts decreasing. In this case, when the bubbling pressure of the bubble in the area A on the upstream-side heat generating member 4*b* is larger than a sum of bubble vanishing forces of the bubbles in the respective areas B on both heat generating members 4*a*, 4*b*, the movable member 8 fails to be displaced downward, and the sealed state is maintained. Additionally, this does not apply when the tip end of the movable member is positioned on the upstream side from a center of the upstream-side heat generating member 4*b*.

FIG. 19A shows that the bubble 21*a* on the downstream-side heat generating member 4*a* substantially grows to maximum. In this state, the bubble grows to maximum in the area A on the downstream-side heat generating member 4*a*, and the bubble in the area B continues to shrink. In this case, when the bubbling pressure of the bubble in the area A on the upstream-side heat generating member 4*b* is weakened, the movable member 8 starts its downward displacement. Moreover, the discharge droplet 22 which is to be discharged from the discharge port 7 trails long and is still connected to the meniscus M. As a result, the liquid supply port 5 opens to place the common liquid supply chamber 6 into the communication state to the liquid flow path 3.

FIG. 19B shows that the growth of the bubble 21*a* on the downstream-side heat generating member 4*a* stops, only a bubble vanishing process is performed, and the discharge droplet 22 is disconnected from the meniscus M. In this state, the movable member 8 is quickly displaced downward by the bubble vanishing force of the bubble in the area B on the upstream-side heat generating member 4*b* and the bubble vanishing force of the bubble in the areas A and B on the downstream-side heat generating member 4*a*. Immediately after the bubble growth changes to bubble vanishing in the area A on the upstream-side heat generating member 4*b*, a bubble shrinkage energy of the bubble acts as a force for moving the liquid in the vicinity of the discharge port 7 to the upstream direction as the entire balance. Therefore, the meniscus M is drawn into the liquid flow path 3 from the discharge port 7 at this point of time, and a liquid column connected to the discharge liquid droplet 22 is quickly cut off with a strong force. In this case, the discharge amount becomes smaller than the total discharge amount when the respective heat generating members 4*a*, 4*b* are individually driven. On the other hand, the movable member 8 is displaced downward with bubble shrinkage, and the liquid rapidly flows as a large flow into the liquid flow path 3 from the common liquid supply chamber 6 via the liquid supply port 5. Thereby, a flow for rapidly drawing the meniscus M into the liquid flow path 3 is rapidly reduced, so that the retreat amount of the meniscus M decreases, and the meniscus M starts to return to a position before bubbling at a relatively low speed. As a result, the converging property of vibration of the meniscus M is very satisfactory as compared with the liquid discharge system which is not provided with the movable member of the present invention.

FIG. 19C shows that the vanishing of the bubble of the downstream-side heat generating member 4*a* almost ends, and the vanishing of the bubble on the upstream-side heat generating member 4*b* ends. In this state, the liquid flows via the liquid supply port 5 from the liquid supply chamber 6, the vanishing of the bubble proceeds and the meniscus M returns. After this state, the movable member is displaced upward by a restoring force by rigidity, and returns to its stationary state position.

As described above, in the mode of simultaneously driving both heat generating members 4*a*, 4*b*, the liquid droplet can be discharged by the discharge amount smaller than the total discharge amount when the respective heat generating members 4*a*, 4*b* are individually driven.

The liquid droplet discharge operation in the mode for first driving the downstream-side heat generating member 4*a* will next be described. FIGS. 20A to 20C and FIGS. 21A to 20C show the characteristic phenomenon of the liquid droplet discharge operation in the mode of first driving the downstream-side heat generating member 4*a* in divided processes of FIGS. 20A to 20C, FIGS. 21A to 21C.

Figure 20A:
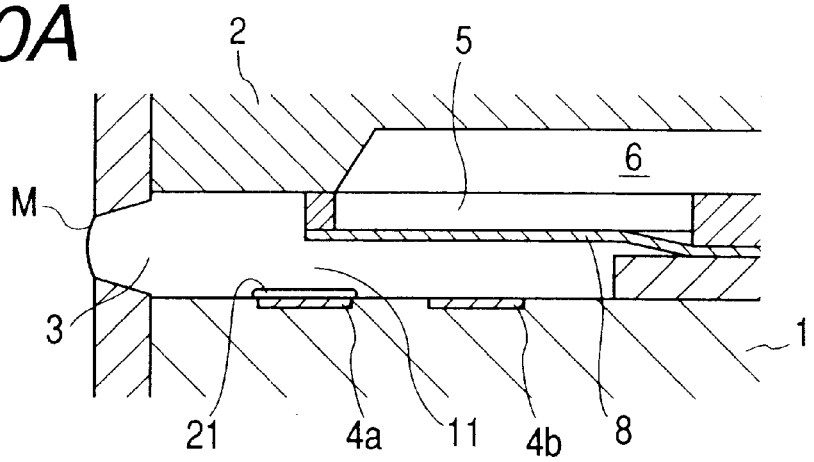
FIGS. 20A, 20B and 20C are explanatory views of the discharge operation of the liquid discharge head with the structure shown in FIGS. 1, 2 and 3.

FIG. 20A shows that by driving only the downstream-side heat generating member 4*a*, a part of the liquid to fill the liquid flow path 3 is heated by the downstream-side heat generating member 4*a*, film boiling occurs on the heat generating member 4 and the bubble 21*a* isotropically grows. Here, "bubble growth is isotropic" means that bubble growth speeds in the perpendicular direction of the bubble surface are substantially equal to one another in any position of the bubble surface.

In the isotropic growth process of the bubble 21*a* in the initial stage of bubble generation, the movable member 8 closely abuts on the peripheral portion of the liquid supply port 5 to close the liquid supply port 5, and the inside of the liquid flow path 3 is substantially in the sealed state excluding the discharge port 7.

Figure 20B:
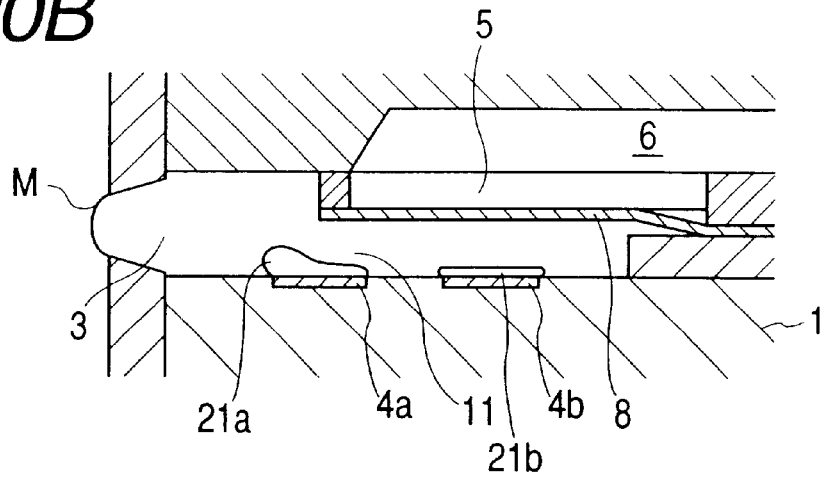

FIG. 20B shows that the bubble growth continues in the area A on the downstream-side heat generating member 4*a*, the bubble shrinkage starts in the area B, and the bubble substantially isotropically grows on the upstream-side heat generating member 4*b*. When the bubble on the downstream-side heat generating member 4*a* shifts to the period of partial growth and partial shrinkage, by driving the upstream-side heat generating member 4*b*, the bubbling pressure of the bubble on the upstream-side heat generating member 4*b* surpasses the vanishing force of the bubble in the area B on the downstream-side heat generating member 4*a*, the movable member 8 fails to be displaced, and the sealed state is maintained.

Figure 20C:
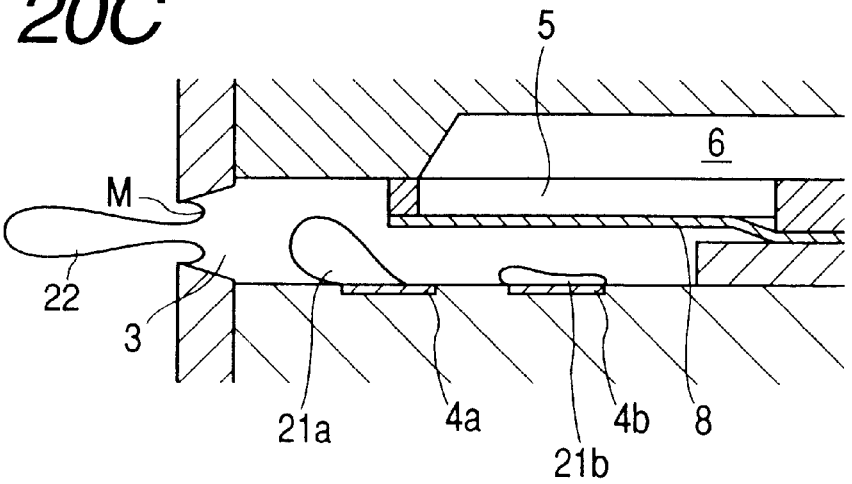

FIG. 20C shows that shows that the bubble 21*a* on the downstream-side heat generating member 4*a* substantially grows to maximum, and the bubble 21*b* on the upstream-side heat generating member 4*b* is in a partial growth and partial shrinkage state. In this state, by the bubble growth on the upstream-side heat generating member 4*b*, the bubble in the area B on the downstream-side heat generating member 4*a* shrinks fast. Moreover, the discharge droplet 22 which is to be discharged from the discharge port 7 trails long and is still connected to the meniscus M. Moreover, the sealed state is continuously maintained.

Figure 21A:
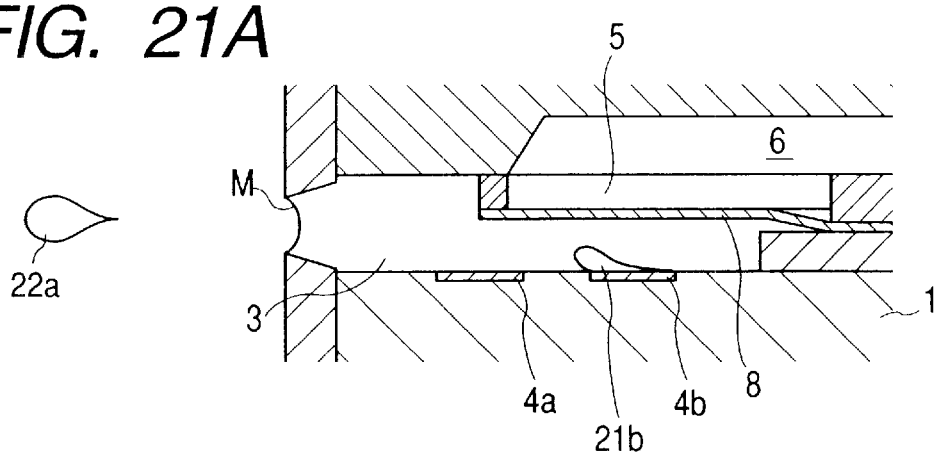
FIGS. 21A, 21B and 21C are explanatory views of the discharge operation of the liquid discharge head with the structure shown in FIGS. 1, 2 and 3.

FIG. 21A shows that the vanishing of the bubble 21*a* on the downstream-side heat generating member 4*a* ends. In this state, the bubble 21*b* on the upstream-side heat generating member 4*b* continues its period of partial growth and partial shrinkage, the bubbling pressure of the bubble in the area A on the upstream-side heat generating member 4*b* surpasses the vanishing force of the bubble in the area B, the movable member 8 fails to be displaced, and the sealed state is still maintained. Moreover, the liquid droplet 22*a* is discharged from the discharge port, and the meniscus M returns without retreating much by the bubbling pressure of the bubble in the area A on the upstream-side heat generating member 4*b*.

Figure 21B:
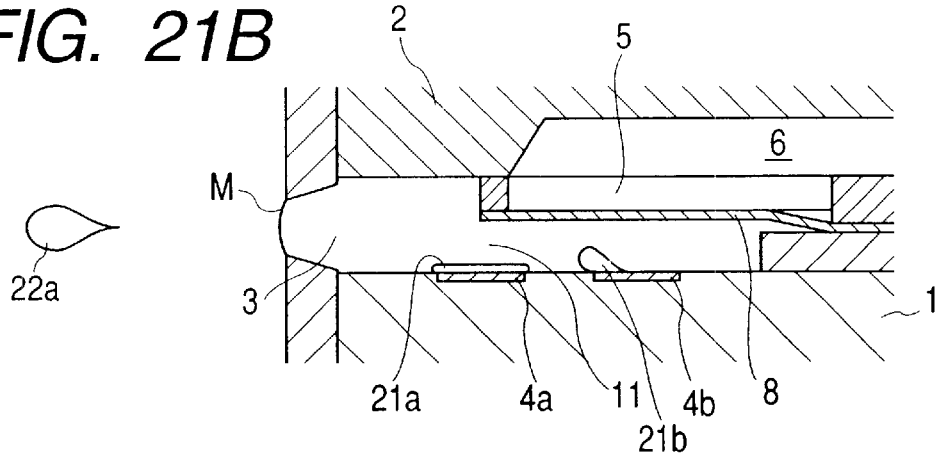

FIG. 21B shows that the bubble substantially isotropically grows on the downstream-side heat generating member 4*a*, and the bubble on the upstream-side heat generating member 4*b* vanishes. By again driving the downstream-side heat generating member 4*a* when the bubble in the area A on the upstream-side heat generating member 4*b* shifts to the bubble vanishing, the bubbling pressure of the bubble on the upstream-side heat generating member 4*b* surpasses the vanishing force of the bubble on the downstream-side heat generating member 4*a*, the movable member 8 fails to be displaced, the sealed state is still maintained, and the meniscus M further returns.

Figure 21C:
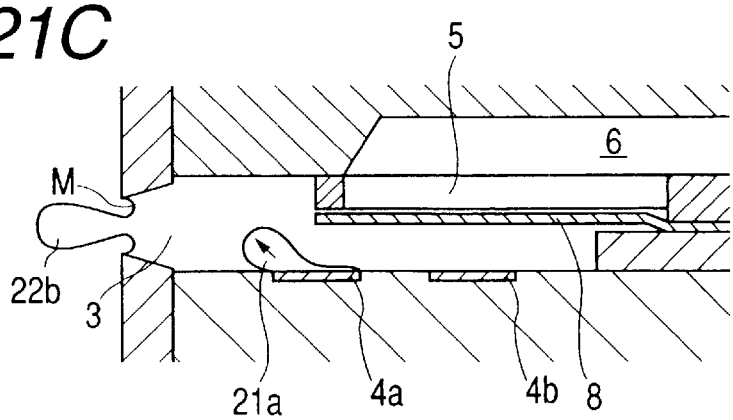

FIG. 21C shows that the bubble on the upstream-side heat generating member 4*b* already completes vanishing, the bubble growth continues in the area A on the downstream-side heat generating member 4*a*, and the bubble shrinkage starts in the area B. In this state, the movable member 8 starts to be displaced to the stationary state position by the restoring force by the rigidity and the vanishing force of the bubble in the area B on the downstream-side heat generating member 4*a*. As a result, the liquid supply port 5 opens to place the common liquid supply chamber 6 in the communication state with the liquid flow path 3.

Thereafter, the second liquid droplet 22*b* is discharged in substantially the same process as that of the liquid discharge operation in FIGS. 6A to 6C. As described above, in the mode of first driving the downstream-side heat generating member 4*a*, two liquid droplets can be discharged in a series of liquid discharge operation, and more discharge amount can be obtained than in the mode of simultaneously driving both heat generating members 4*a*, 4*b*.

Figure 22A:
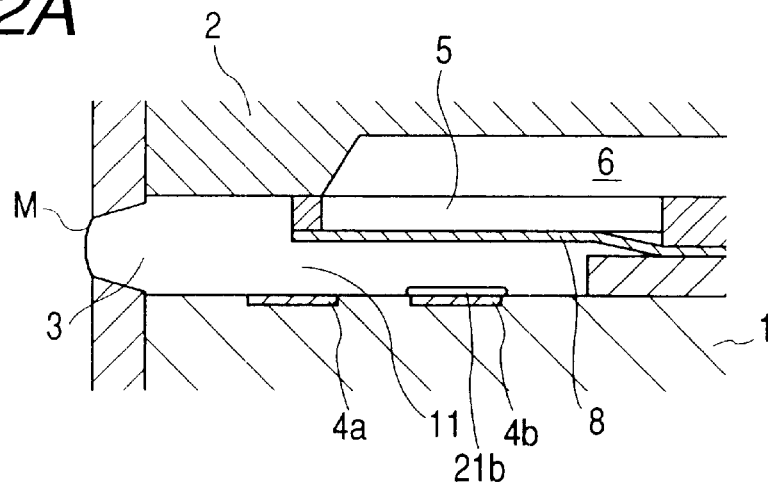
FIGS. 22A, 22B and 22C are explanatory views of the discharge operation of the liquid discharge head with the structure shown in FIGS. 1, 2 and 3.
Figure 22B:
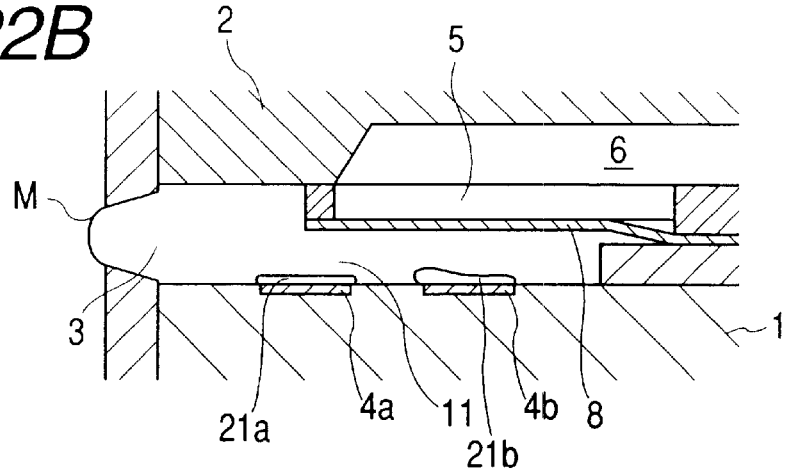
Figure 22C:
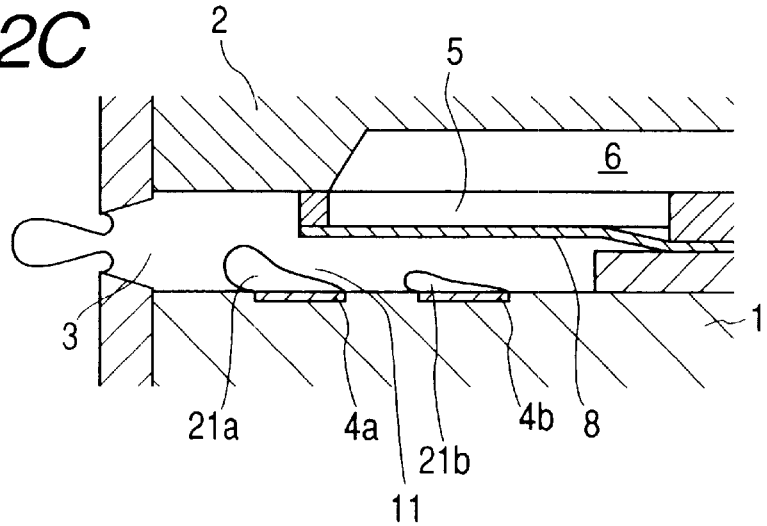
Figure 23A:
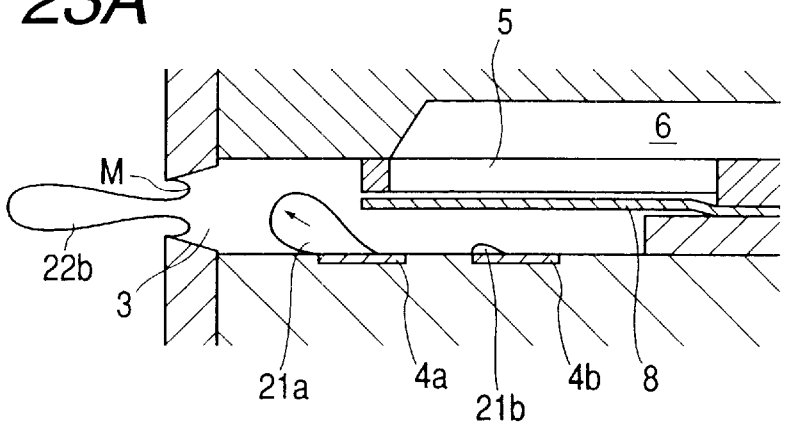
FIGS. 23A, 23B and 23C are explanatory views of the discharge operation of the liquid discharge head with the structure shown in FIGS. 1, 2 and 3.
Figure 23B:
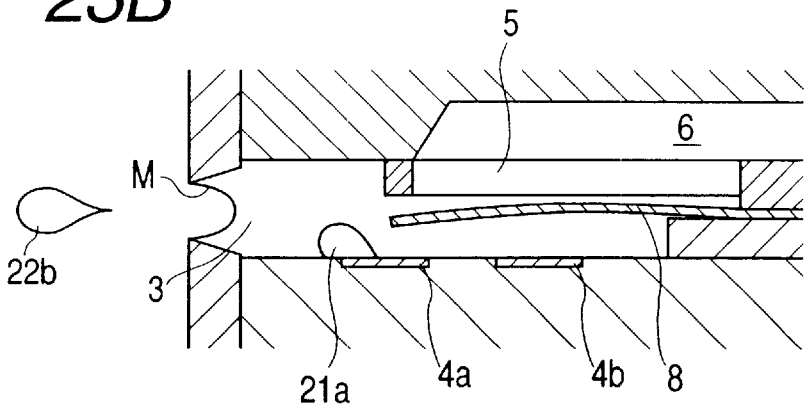
Figure 23C:
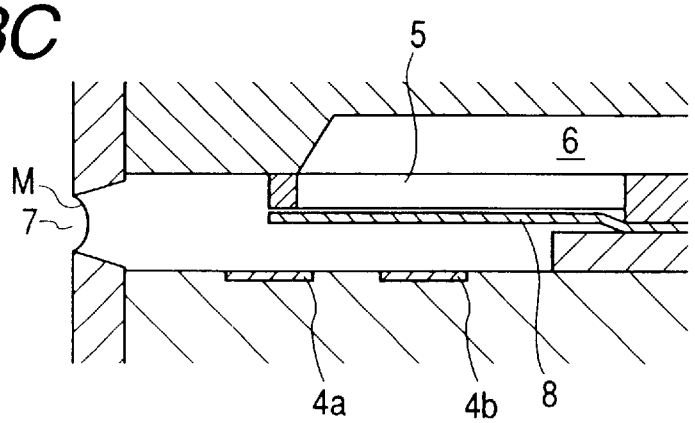

The liquid droplet discharge operation in the mode for first driving the upstream-side heat generating member 4*b* will next be described. FIGS. 22 and 23 show the characteristic phenomenon of the liquid droplet discharge operation in the mode of first driving the upstream-side heat generating member 4*b* in divided processes of FIGS. 22A to 22C, FIGS. 23A to 23C.

FIG. 22A shows that by driving only the upstream-side heat generating member 4*b*, a part of the liquid to fill the liquid flow path 3 is heated by the upstream-side heat generating member 4*b*, the film boiling occurs on the heat generating member 4 and the bubble 21*b* isotropically grows. Here, "bubble growth is isotropic" means that bubble growth speeds in the perpendicular direction of the bubble surface are substantially equal to one another in any position of the bubble surface.

In the isotropic growth process of the bubble 21*b* in the initial stage of bubble generation, the movable member 8 closely abuts on the peripheral portion of the liquid supply port 5 to close the liquid supply port 5, and the inside of the liquid flow path 3 is substantially in the sealed state excluding the discharge port 7.

FIG. 22B shows that in a period when the bubble on the upstream-side heat generating member 4*b* entirely grows, the downstream-side heat generating member 4*a* is driven, and the bubble on the downstream-side heat generating member 4*a* substantially isotropically grows. After this state, as shown in FIG. 22C, both the bubbles 21*a*, 21*b* on both heat generating members 4*a*, 4*b* shift to the period of partial growth and partial shrinkage. Furthermore, the bubble on the upstream-side heat generating member 4*b* fast shifts to its shrinkage period by the bubbling pressure of the bubble on the downstream-side heat generating member 4*a*.

FIG. 23A shows that for the bubble 21*a* on the downstream-side heat generating member 4*a* the period of partial growth and partial shrinkage continues, and the bubble 21*b* on the upstream-side heat generating member 4*b* vanishes. In this state, in accordance with the restoring force by rigidity and the vanishing force of the bubble in the area B on the downstream-side heat generating member 4*a* and in the areas A and B on the upstream-side heat generating member 4*b*, the movable member 8 starts to be displaced downward more quickly than in the mode of simultaneously driving both the heat generating members 4*a*, 4*b*. As a result, liquid supply port 5 opens to place the common liquid supply chamber 6 in the communication state with the liquid flow path 3.

FIG. 23B shows only the stage of the bubble vanishing process, and that the discharge droplet 22 is disconnected from the meniscus M. Immediately after the bubble growth changes to bubble vanishing in the area A, the shrinkage energy of the bubble 21 acts as the force for moving the liquid in the vicinity of the discharge port 7 to the upstream direction as the entire balance. Therefore, the meniscus M is drawn into the liquid flow path 3 from the discharge port 7 at this point of time, and the liquid column connected to the discharge liquid droplet 22 is cut off. On the other hand, with the bubble shrinkage, the movable member 8 is displaced downward, and the liquid rapidly flows as a large flow into the liquid flow path 3 from the common liquid supply chamber 6 via the liquid supply port 5. Thereby, since the flow for rapidly drawing the meniscus M into the liquid flow path 3 is rapidly reduced, the retreat amount of the meniscus M can be decreased, and the meniscus M starts to return to the position before bubbling at a relatively low speed. As a result, the converging property of vibration of the meniscus M is very satisfactory as compared with the liquid discharge system which is not provided with the movable member of the present invention.

FIG. 23C shows that the bubble completely vanishes, and the movable member 8 also returns to the stationary state position. The movable member 8 is displaced upward to this stat e by its elastic force. Moreover, in this state, the meniscus M already returns to the vicinity of the discharge port 7.

As described above, in the mode of first driving the upstream-side heat generating member 4*b*, since the movable member can be displaced downward more quickly than in the mode of simultaneously driving both heat generating members 4*a*, 4*b*, the refill property can further be enhanced.

(Other Embodiments)

Various mode examples preferable for the head using the aforementioned liquid discharge principle will be described hereinafter.

<Element Substrate>

A constitution of the element substrate 1 provided with the heat generating member 4 for applying heat to the liquid will be described hereinafter. Additionally, for the sake of convenience a constitution in which one heat generating member 4 is disposed in the liquid flow path 3 will be described hereinafter.

Figure 13A:
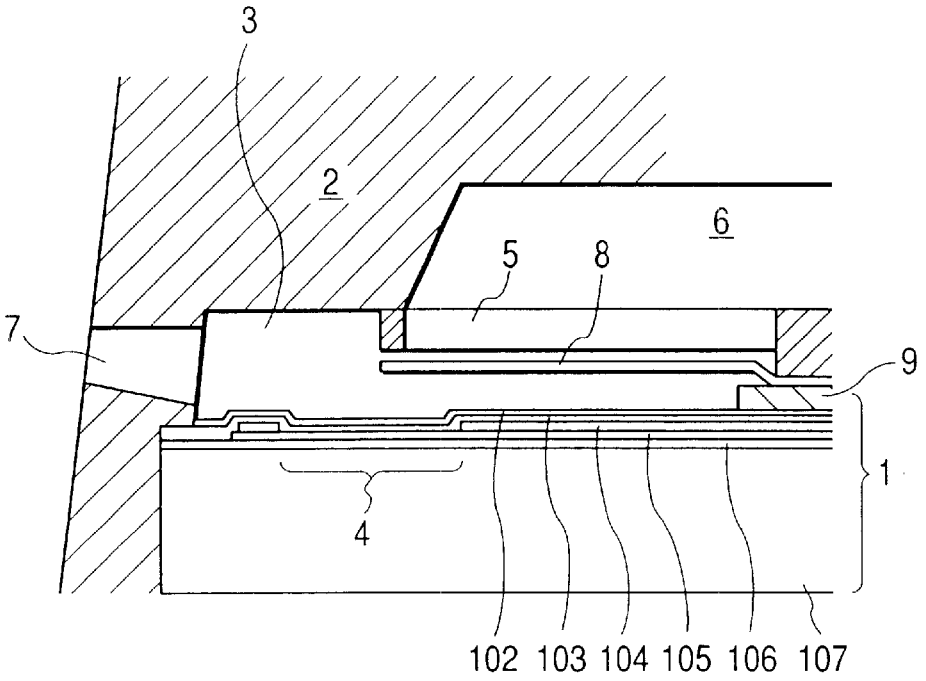
FIGS. 13A and 13B are longitudinal sectional views of the liquid discharge head of the present invention with a protective film and without the protective film, respectively.
Figure 13B:
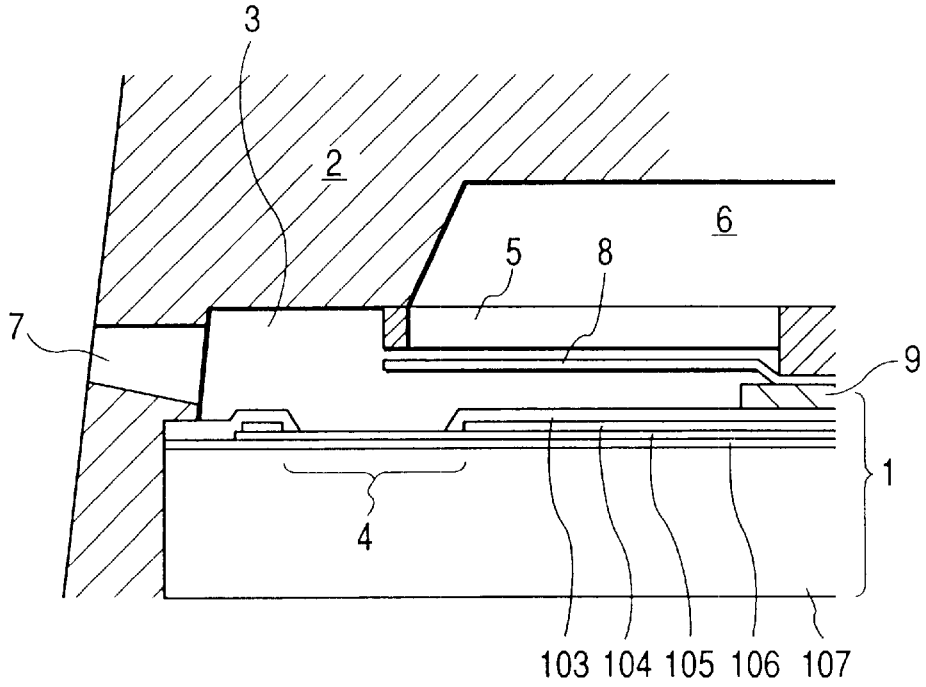

FIGS. 13A and 13B show side sectional views of a main part of a liquid discharge apparatus of the present invention, FIG. 13A shows the head with a protective film described later, and FIG. 13B shows the head without the protective film. The top plate 2 is disposed on the element substrate 1, and the liquid flow path 3 is formed between the element substrate 1 and the top plate 2.

For the element substrate 1, a silicon oxide film or a silicon nitride film 106 for purposes of insulation and heat storage is formed on a substrate 107 of silicon or the like, and on the film an electric resistance layer 105 (thickness of 0.01 to 0.2 $\mu$m) of hafnium boride ($HfB_2$), tantalum nitride (TaN), tantalum aluminum (TaAl) or the like and a wiring electrode 104 (thickness of 0.2 to 1.0 $\mu$m) of aluminum or the like are patterned to constitute the heat generating member 4 as shown in FIG. 13A. By applying voltage to the resistance layer 105 from the wiring electrode 104 and 15 passing current through the resistance layer 105, the heat generating member 4 generates heat. A protective film 103 of silicon oxide, silicon nitride or the like is formed with a thickness of 0.1 to 2.0 $\mu$m on the resistance layer 105 between the wiring electrodes 104, and further on the film a cavitation-resistant layer 102 of tantalum or the like (thickness of 0.1 to 0.6 $\mu$m) is formed, so that the resistance layer 105 is protected from various liquids such as the ink.

Particularly, pressures and impact waves generated during bubble generation and vanishing are so strong that durability of the hard and brittle oxide film is remarkably deteriorated, and therefore metal materials such as tantalum (Ta) are used as the cavitation-resistant layer 102.

Moreover, the aforementioned resistance layer 105 may require no protective film 103 by combination of the liquid, flow path constitution, and resistance material, and an example of such constitution is shown in FIG. 13B. As the material of the resistance layer 105 which requires no protective film 103, iridium-tantalum-aluminum alloy, and the like are exemplified.

As described above, the heat generating member 4 in the aforementioned respective embodiments may be constituted only of the resistance layer 105 (heat generator) between the electrodes 104, or may include the protective film 103 to protect the resistance layer 105.

In the respective embodiments, the heat generator constituted of the resistance layer 105 which generates heat in response to an electric signal is used as the heat generating member 4, but this is not limited, and the constitution may generate the bubble sufficient for discharging the discharge liquid in a bubbling liquid. For example, the heat generating member may comprise a photothermal converting element which receives laser or another light to generate the heat or a heat generator which receives a high frequency to generate the heat.

Additionally, for the element substrate 1, in addition to the heat generating member 4 including the resistance layer 105 constituting the aforementioned heat generator and the wiring electrode 104 for supplying the electric signal to the resistance layer 105, the function elements such as the transistor, diode, latch, and shift register for selectively driving the heat generating member 4 (electrothermal converting element) may integrally be formed by a semiconductor manufacture process.

Figure 14:
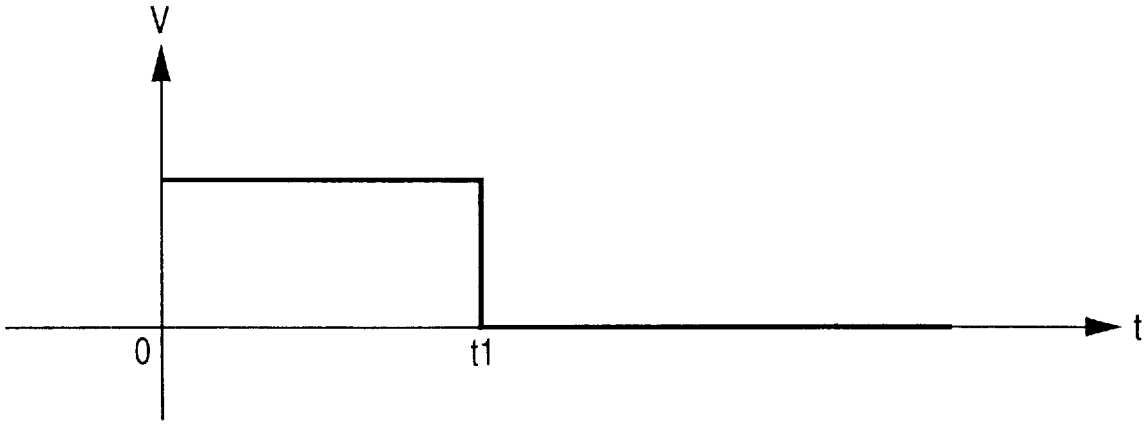
FIG. 14 is a waveform chart of a pulse wave for driving the heat generating member for use in the present invention.

Moreover, in order to drive the heat generator of the heat generating member 4 disposed on the element substrate I as described above, and discharge the liquid, by applying a rectangular pulse to the resistance layer 105 via the wiring electrode 104 as shown in FIG. 14, the resistance layer 105 between the wiring electrodes 104 is steeply allowed to generate the heat. In the aforementioned head of the respective embodiments, by applying a voltage of 24V, pulse width of 7 $\mu$sec, current of 150 mA, and electric signal at 6 kHz to drive the heat generating member, the ink as the liquid is discharged from the discharge port 7 by the aforementioned operation. However, drive signal conditions are not limited to these, and a drive signal which can adequately bubble the bubbling liquid may be used.

<Discharge Liquid>

Among the liquids, the ink of the composition used in a conventional bubble jet apparatus can be used as the liquid for use in recording (recording liquid).

Additionally, as the property of the discharge liquid the discharge liquid itself desirably fails to inhibit the discharge, the bubbling, the operation of the movable member, or the like.

A highly viscous ink or the like can be utilized as the recording discharge liquid.

In the present invention, the ink of the following composition is used as the recording liquid which can be used in the discharge liquid and the recording is performed, but the ink discharge speed is raised by enhancement of the discharge force, and therefore reaching precision of liquid droplet is enhanced so that a very satisfactory recorded image can be obtained.

| Dye ink viscosity 2 cP | |
|---|---|
| (C.I. food black 2) dye | 3 wt % |
| diethylene glycol | 10 wt % |
| thiodiglycol | 5 wt % |
| ethanol | 3 wt % |
| water | 77 wt % |

<Liquid Discharge Apparatus>

Figure 15:
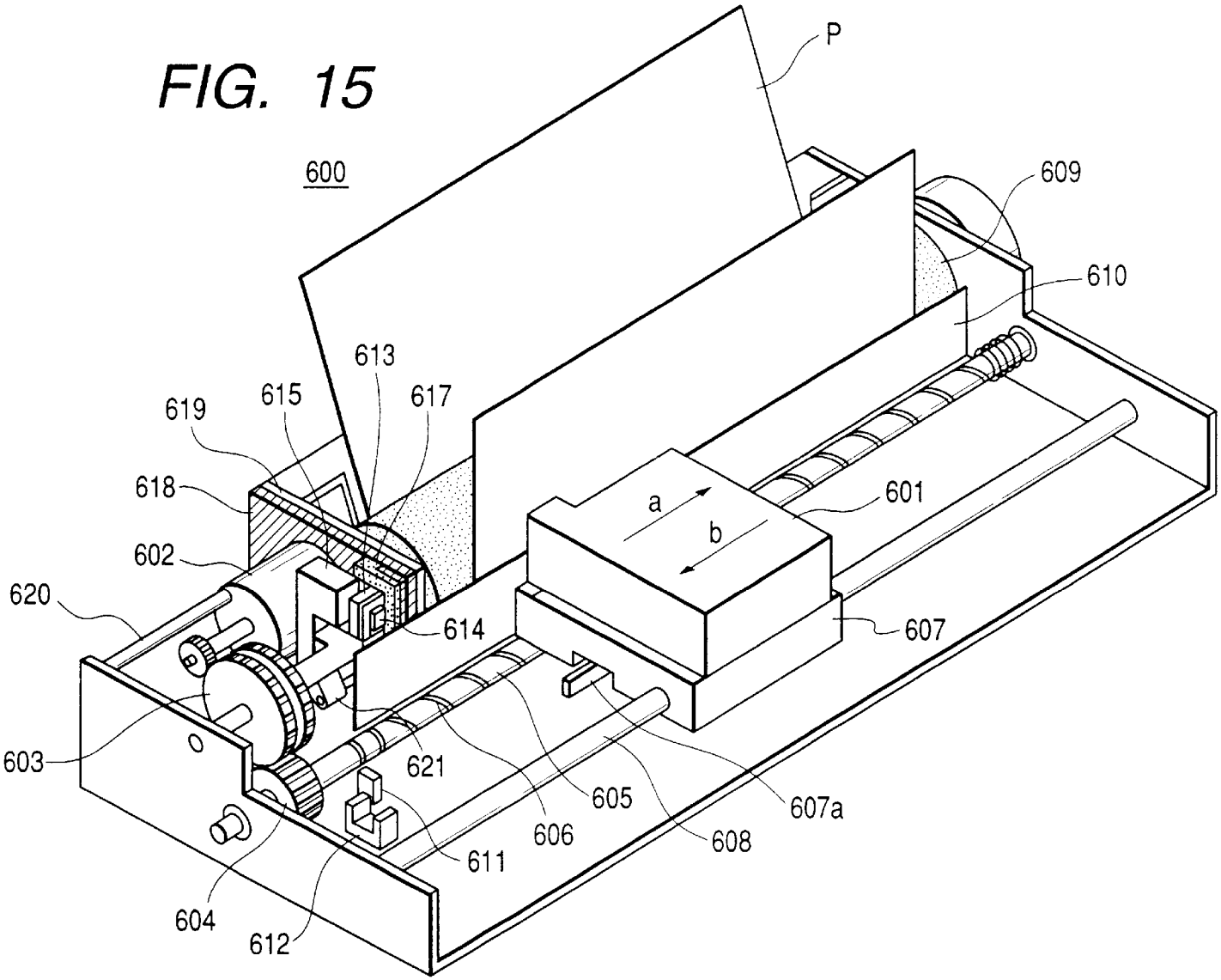
FIG. 15 is a schematic view showing a constitution of a liquid discharge apparatus on which the liquid discharge head of the present invention is mounted.

FIG. 15 schematically shows a constitution of an ink jet recording apparatus as one example of a liquid discharge apparatus on which the liquid discharge head of the structure described in the present embodiment can be mounted and applied. A head cartridge 601 mounted on an ink jet recording apparatus 600 shown in FIG. 15 includes the liquid discharge head of the aforementioned structure, and a liquid container for holding the liquid supplied to the liquid discharge head. As shown in FIG. 15, the head cartridge 601 is mounted on a carriage 607 which meshes with a helical groove 606 of a lead screw 605 rotating via drive force transmission gears 603 and 604 in cooperation with forward/backward rotation of a driving motor 602. By a power of the driving motor 602 the head cartridge 601 reciprocates/moves together with the carriage 607 along a guide 608 in directions of arrows a and b. The ink jet recording apparatus 600 is provided with recording medium conveying means (not shown) for conveying a printing sheet P as the recording medium which receives the ink or another liquid discharged from the head cartridge 601. A sheet press plate 610 of the printing sheet P conveyed on a platen 609 by the recording medium conveying means presses the printing sheet P onto the platen 609 over a moving direction of the carriage 607.

Photocouplers 611 and 612 are disposed in the vicinity of one end of the lead screw 605. The photocouplers 611 and 612 are home position detecting means for confirming the presence of a lever 607*a* of the carriage 607 in an area of the photocouplers 611 and 612 to switch a rotation direction of the driving motor 602. Disposed in the vicinity of one end of the platen 609 is a support member 613 for supporting a cap member 614 which covers a front surface provided with a discharge port of the head cartridge 601. Moreover, ink suction means 615 is disposed which sucks the ink stored inside the cap member 614 by empty discharge from the head cartridge 601. Suction recovery of the head cartridge 601 is performed via an opening of the cap member 614 by the ink suction means 615.

The ink jet recording apparatus 600 is provided with a main body support member 619. The main body support member 619 supports a moving member 618 so that the member can move in a forward/backward direction, that is, a direction extended at right angles to the moving direction of the carriage 607. A cleaning blade 617 is attached to the moving member 618. The cleaning blade 617 is not limited to this mode, and a known cleaning blade of another mode may be used. Furthermore, a lever 620 for starting the suction in a suction recovery operation by the ink suction means 615 is disposed, the lever 620 moves with movement of a cam 621 which meshes with the carriage 607, and a drive force from the driving motor 602 is controlled for the movement by known transmission means such as clutch switching. An ink jet recording controller for applying a signal to the heat generating member mounted on the head cartridge 601 or performing drive control of the aforementioned respective mechanisms is disposed on a recording apparatus main body side, and this is not shown in FIGS. 11A and 11B.

In the ink jet recording apparatus 600 provided with the aforementioned constitution, the head cartridge 601 reciprocates/moves over the entire width of the printing sheet P with respect to the printing sheet P conveyed on the platen 609 by the recording medium conveying means. When the drive signal is supplied to the head cartridge 601 from drive signal supply means (not shown) during the movement, in. response to the signal the liquid discharge head portion discharges the ink (recording liquid) to the recording medium, and recording is performed.

Figure 16:
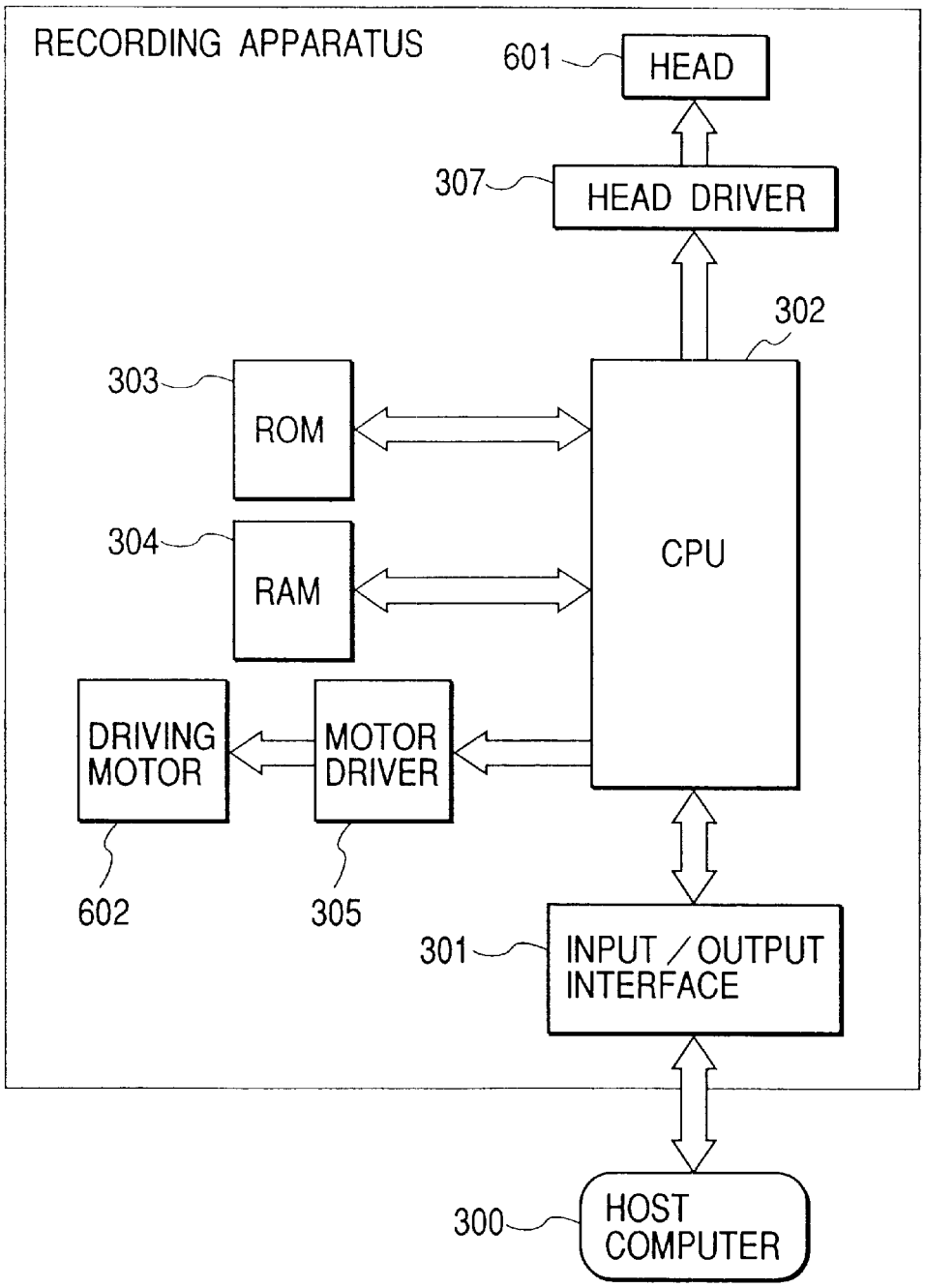
FIG. 16 is a block diagram of the entire apparatus for performing liquid discharge recording in the liquid discharge method and liquid discharge head of the present invention.
Figure 17D:
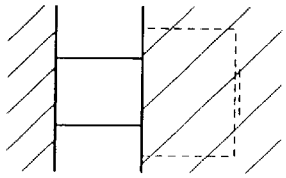
FIGS. 17A, 17B, 17C and 17D are sectional views showing another embodiment of the liquid discharge head of the present invention.
Figure 17C:
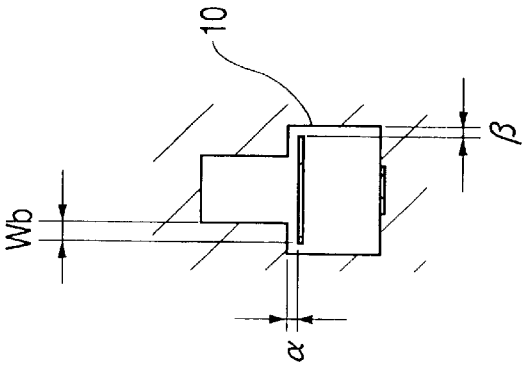
Figure 17A:
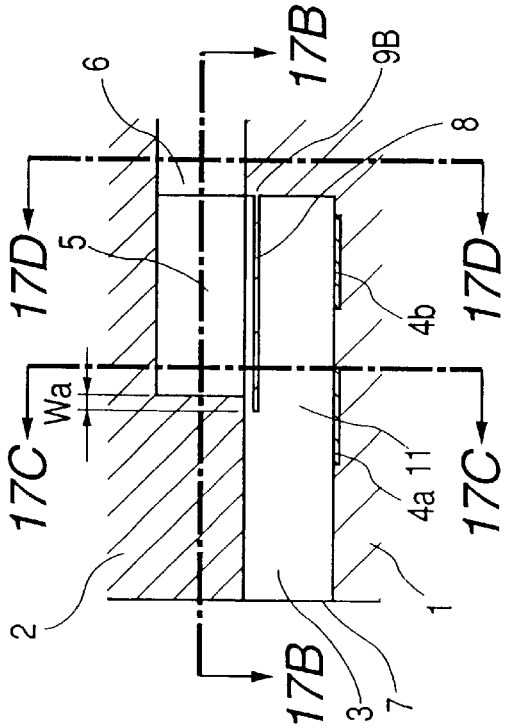
Figure 17B:
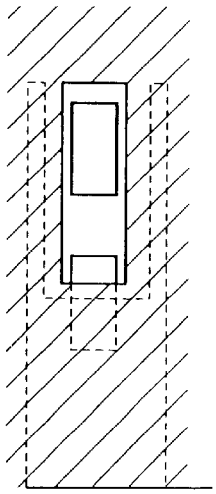

FIG. 16 is a block diagram of the entire recording apparatus for performing ink jet recording by the liquid discharge apparatus of the present invention.

The recording apparatus receives printing information as a control signal from a host computer 300. The printing information is temporarily stored in an input interface 301 inside a printing apparatus, converted to data which can be processed in the recording apparatus, and inputted to a central processing unit (CPU) 302 which also serves as head drive signal supply means. The CPU 302 uses peripheral units such as a random access memory (RAM) 304 to process the data inputted to the CPU 302 based on a control program stored in a read only memory (ROM) 303, and converts the data to data to be printed (image data).

Moreover, in order to record the image data to an appropriate position on the recording sheet, the CPU 302 prepares drive data for driving the driving motor 602 to move the recording sheet and the carriage 607 with the head cartridge 601 mounted thereon in synchronization with the image data. The image data and the motor drive data are transmitted to the head cartridge 601 and the driving motor 602 via a head driver 307 and a motor driver 305, respectively, and the motor is driven at a controlled timing to form an image. As the recording medium 150 which is used in the recording apparatus and to which the liquid such as the ink is applied, various papers or OHP sheets, plastic materials for use in a compact disk, decorating plate, and the like, cloth, metal materials such as aluminum and copper, leathers such as ox/cow hide, pigskin and artificial leather, wood materials such as wood and plywood, bamboo materials, ceramic materials such as tiles, three-dimensional structure materials such as sponge, and the like can be used.

Moreover, the recording apparatus includes a printer apparatus for performing recording on various papers, OHP sheets, and the like, a plastic recording apparatus for performing recording on the plastic materials such as the compact disk, a metal recording apparatus for performing recording on a metal plate, a leather recording apparatus for performing recording on the leather, a wood material recording apparatus for performing recording on the wood material, a ceramic recording apparatus for performing recording on the ceramic material, a recording apparatus for performing recording on the three-dimensional net structure materials such as the sponge, a textile printing apparatus for performing recording on the cloth, and the like.

Moreover, as the discharge liquid for use in the liquid discharge apparatus, liquids adapted to recording media and recording conditions may be used. Effect of the Invention FIGS. 17A to 17D are sectional views of another modification of the liquid discharge head of the present invention.

In the liquid discharge head of the mode shown in FIGS. 17A to 17D, the element substrate 1 is bonded to the top plate 2, and the liquid flow path 3 whose one end communicates with the discharge port 7 is formed between the element substrate 1 and the top plate 2. Moreover, the heat generating members 4*a*, 4*b* are disposed as bubble generating means for generating the bubble in the liquid with which the liquid flow path 3 is refilled. Disposed in the liquid flow path 3 are the liquid supply port 5 and the common liquid supply chamber which communicates with the liquid supply port 5.

Between the liquid supply port 5 and the liquid flow path 3, the movable member 8 is disposed with the slight gap $\alpha$ (e.g., 10 $\mu$m or less) with respect to the forming surface of the liquid supply port 5. The area surrounded with at least the free end portion of the movable member 8 and continued both side portions is larger than the opening area S to the liquid flow path of the liquid supply port 5, and the side portion of the movable member 8 has the slight gap $\beta$ from the liquid flow path side wall 10. Thereby, the movable member 8 can move inside the liquid flow path 3 without any frictional resistance, the displacement to the opening area side is restricted in the peripheral portion of the opening area S, the liquid supply port 5 is substantially closed so that the liquid flow to the common liquid supply chamber 6 from the liquid flow path 3 can be prevented, and with bubble vanishing, movement is possible to a refill possible state from the substantially sealed state on the liquid flow path side. Moreover, in the present embodiment, the movable member 8 is disposed opposite to the element substrate 1. Furthermore, one end of the movable member 8 is a free end displaced on the side of the heat generating members 4*a*, 4*b* of the element substrate 1, and the other end is supported by the support member 9.

What is claimed is:

1. A liquid discharge head comprising:

a discharge port for discharging a liquid;

a liquid flow path whose one end portion constantly communicates with the discharge port and which comprises a bubble generating area for generating a bubble in the liquid;

a liquid supply port disposed in said liquid flow path and connected to a common liquid supply chamber for storing the liquid to be supplied to said liquid flow path;

a plurality of bubble generating means, disposed in said liquid flow path, for generating the bubble in the liquid; and a plate-like movable member disposed in said liquid flow path with the side of said discharge port supported as a free end at a gap of 10 $\mu$m or less with respect to the liquid supply port on the side of said liquid flow path, and provided with a projection area larger than an opening area of said liquid supply port, wherein said discharge port is in a linear communication state with said bubble generating means, and by driving the bubble generating means for generating the bubble with a smallest volume among said plurality of bubble generating means, said movable member seals and substantially shuts off said liquid supply port.

2. The liquid discharge head according to claim 1 wherein said plurality of bubble generating means disposed in said liquid flow path are arranged in order in which a bubbling area gradually increases toward an upstream side from a downstream side of said liquid flow path.

3. The liquid discharge head according to claim 1 wherein there is also a gap between a liquid flow path wall constituting said liquid flow path and said movable member.

4. The liquid discharge head according to claim 1 wherein the liquid is discharged by driving said plurality of bubble generating means.

5. The liquid discharge head according to claim 4 wherein the liquid is discharged by simultaneously driving said plurality of bubble generating means.

6. The liquid discharge head according to claim 4 wherein the liquid is discharged by first driving the bubble generating means closest to the discharge port side among said plurality of bubble generating means.

7. The liquid discharge head according to claim 4 wherein the liquid is discharged by first driving the bubble generating means closest to a movable member side among said plurality of bubble generating means.

8. A liquid discharge apparatus comprising:

the liquid discharge head according to claim 1; and drive signal supply means for supplying a drive signal to discharge the liquid from the liquid discharge head.

9. The liquid discharge apparatus according to claim 8 which discharges the liquid from the liquid discharge head, and attaches the liquid to a recording medium to perform recording.

10. A liquid discharge apparatus comprising:

the liquid discharge head according to claim 1; and recording medium conveying means for conveying a recording medium to receive the liquid discharged from the liquid discharge head.

11. The liquid discharge apparatus according to claim 10 which discharges the liquid from said liquid discharge head, and attaches said the liquid to a recording medium to perform recording.

12. A liquid discharge head comprising:

a discharge port for discharging a liquid;

a liquid flow path whose one end portion constantly communicates with the discharge port and which comprises a plurality of bubble generating areas for generating a bubble in the liquid;

a liquid supply port disposed in said liquid flow path and connected to a common liquid supply chamber for storing the liquid to be supplied to said liquid flow path;

a plurality of bubble generating means, disposed in said liquid flow path, for generating the bubble in the liquid; and a plate-like movable member disposed in said liquid flow path with the side of said discharge port supported as a free end at a gap of 10 $\mu$m or less with respect to said liquid supply port on the side of said liquid flow path, and provided with a projection area larger than an opening area of said liquid supply port, wherein said discharge port is in a linear communication state with said bubble generating means, and by selecting one of said plurality of bubble generating means, during generation of the bubble, and even during driving of any bubble generating means, said movable member seals and shuts off said liquid supply port.

13. The liquid discharge head according to claim 12 wherein said plurality of bubble generating means disposed in said liquid flow path are arranged in order in which a bubbling area gradually increases toward an upstream side from a downstream side of said liquid flow path.

14. The liquid discharge head according to claim 12 wherein there is also a gap between a liquid flow path wall constituting said liquid flow path and said movable member.

15. The liquid discharge head according to claim 12 wherein the liquid is discharged by driving said plurality of bubble generating means.

16. The liquid discharge head according to claim 15 wherein the liquid is discharged by simultaneously driving said plurality of bubble generating means.

17. The liquid discharge head according to claim 15 wherein the liquid is discharged by first driving the bubble generating means closest to the discharge port side among said plurality of bubble generating means.

18. The liquid discharge head according to claim 15 wherein the liquid is discharged by first driving the bubble generating means closest to a movable member side among said plurality of bubble generating means.

19. A liquid discharge apparatus comprising:

the liquid discharge head according to claim 12; and drive signal supply means for supplying a drive signal to discharge the liquid from the liquid discharge head.

20. The liquid discharge apparatus according to claim 19 which discharges the liquid from said liquid discharge head, and attaches said liquid to a recording medium to perform recording.

21. A liquid discharge apparatus comprising:

the liquid discharge head according to claim 12; and recording medium conveying means for conveying a recording medium to receive the liquid discharged from the liquid discharge head.

22. The liquid discharge apparatus according to claim 21 which discharges the liquid from the liquid discharge head, and attaches the liquid to a recording medium to perform recording.

23. A liquid discharge method using a liquid discharge head comprising:

a discharge port for discharging a liquid;

a liquid flow path connected to the discharge port and provided with a bubble generating area for generating a bubble in the liquid;

a plurality of liquid supply ports disposed in the liquid flow path and connected to a common liquid supply chamber for storing the liquid to be supplied to the liquid flow path;

a plurality of bubble generating means, disposed in the liquid flow path, for generating the bubble in the liquid with which the liquid flow path is filled; and a movable member disposed in the liquid flow path with the side of the discharge port supported/fixed as a free end at a slight gap between a liquid flow path wall constituting the liquid flow path and the liquid supply port with respect to the liquid flow path wall and the liquid discharge port on the side of the liquid flow path, and provided with a projection area larger than an opening area of the liquid supply port, said method comprising a step of: driving the bubble generating means for generating the bubble with a smallest volume among the plurality of bubble generating means, so that from when a drive voltage is applied to the bubble generating means until a period of isotropic growth of the entire bubble ends, the movable member seals and shuts off the liquid supply port.

24. The liquid discharge method according to claim 23 wherein a bubble growth volume change and a time from bubble generation until bubble vanishing largely differ between the discharge port side and the liquid supply port side in the bubble generating area.

25. The liquid discharge method according to claim 23 wherein the bubble generating area fails to be opened to atmosphere.

26. The liquid discharge method according to claim 23, comprising a step of driving the plurality of bubble generating means to discharge the liquid.

27. The liquid discharge method according to claim 26, comprising a step of simultaneously driving the plurality of bubble generating means to discharge the liquid.

28. The liquid discharge method according to claim 26, comprising a step of first driving the bubble generating means closest to the discharge port side among the plurality of bubble generating means to discharge the liquid.

29. The liquid discharge method according to claim 26, comprising a step of first driving the bubble generating means closest to a movable member side among the plurality of bubble generating means to discharge the liquid.

30. A liquid discharge method using a liquid discharge head comprising:

a discharge port for discharging a liquid;

a liquid flow path connected to the discharge port and provided with a plurality of bubble generating areas for generating a bubble in the liquid;

a plurality of liquid supply ports disposed in the liquid flow path and connected to a common liquid supply chamber for storing the liquid to be supplied to the liquid flow path;

a plurality of bubble generating means, disposed in the liquid flow path, for generating the bubble in the liquid with which the liquid flow path is filled; and a movable member disposed in the liquid flow path with the side of the discharge port supported/fixed as a free end at a slight gap between a liquid flow path wall constituting the liquid flow path and the liquid supply port with respect to the liquid flow path wall and the liquid supply port on the side of the liquid flow path, and provided with a projection area larger than an opening area of the liquid supply port, said method comprising a step of selecting one of the plurality of bubble generating means, so that during generation of the bubble, and even during driving of any bubble generating means, from when a drive voltage is applied to the bubble generating means until a period of isotropic growth of the entire bubble ends, the movable member seals and shuts off the liquid supply port.

31. The liquid discharge method according to claim 30 wherein a bubble growth volume change and a time from bubble generation until bubble vanishing largely differ between the discharge port side and the liquid supply port side in the bubble generating area.

32. The liquid discharge method according to claim 30 wherein the bubble generating area fails to be opened to atmosphere.

33. The liquid discharge method according to claim 30, comprising a step of driving the plurality of bubble generating means to discharge the liquid.

34. The liquid discharge method according to claim 33, comprising a step of simultaneously driving the plurality of bubble generating means to discharge the liquid.

35. The liquid discharge method according to claim 33, comprising a step of first driving the bubble generating means closest to the discharge port side among the plurality of bubble generating means to discharge the liquid.

36. The liquid discharge method according to claim 33, comprising a step of first driving the bubble generating means closest to a movable member side among the plurality of bubble generating means to discharge the liquid.

* * * * *

UNITED STATES PATENT AND TRADEMARK OFFICE

CERTIFICATE OF CORRECTION

PATENT NO. : 6,435,661 B1
DATED : August 20, 2002
INVENTOR(S) : Ryoji Inoue et al.

It is certified that error appears in the above-identified patent and that said Letters Patent is hereby corrected as shown below:

Title page,
Item [57], ABSTRACT,
Line 1, “comprises” should read -- comprising --.

Column 14,
Line 34, “Vdl” should read -- Vd1 --; and
Line 62, “are” should read -- is --.

Column 15,
Line 1, “Sel,” should read -- Se1, --; and “Vdl,” should read -- Vd1, --; and
Lines 38, 43, 44, 48, 58, 62 and 65, “both” should read -- both of --.

Column 16,
Lines 2, 5, 8, 10 and 11, “both” should read -- both of --.

Column 18,
Line 8, “shows that shows” should read -- shows --.

Column 19,
Line 23, “both the” should read -- both --; and
Line 39, “both” should read -- both of --.

Column 20,
Line 1, “stat e” should read -- state --; and
Line 36, “15” should be deleted.

Column 22,
Line 51, “in.” should read -- in --.

Column 23,
Line 34, “used. Effect” should read -- used. ¶ Effect --.

Column 24,
Lines 30, 35 and 38, “claim 1” should read -- claim 1, --;
Lines 41, 44 and 48, “claim 4” should read -- claim 4, --;
Line 56, “claim 8” should read -- claim 8, --; and
Line 66, “claim 10” should read -- claim 10, --.

UNITED STATES PATENT AND TRADEMARK OFFICE

CERTIFICATE OF CORRECTION

PATENT NO. : 6,435,661 B1
DATED : August 20, 2002
INVENTOR(S) : Ryoji Inoue et al.

It is certified that error appears in the above-identified patent and that said Letters Patent is hereby corrected as shown below:

Column 25,
Line 1, “said the” should read -- the --;
Lines 28, 33 and 36, “claim 12” should read -- claim 12, --;
Lines 39, 42 and 46, “claim 15” should read -- claim 15, --;
Line 54, “claim 19” should read -- claim 19, --; and
Line 64, “claim 21” should read -- claim 21, --.

Column 26,
Lines 30 and 35, “claim 23” should read -- claim 23, --.

Column 27,
Line 15, “claim 30” should read -- claim 30, --.

Column 28,
Line 1, “claim 30” should read -- claim 30, --.

Signed and Sealed this

Twenty-ninth Day of April, 2003

JAMES E. ROGAN
*Director of the United States Patent and Trademark Office*